US010016646B2

(12) United States Patent
Butler

(10) Patent No.: US 10,016,646 B2
(45) Date of Patent: Jul. 10, 2018

(54) MULTIFUNCTIONAL EXERCISE MACHINES

(71) Applicant: BodyForce Inc., Salt Lake City, UT (US)

(72) Inventor: Brian C. Butler, Lehigh, UT (US)

(73) Assignee: BodyForce, Inc., Salt Lake City, UT (US)

( * ) Notice: Subject to any disclaimer, the term of this patent is extended or adjusted under 35 U.S.C. 154(b) by 230 days.

(21) Appl. No.: 14/026,871

(22) Filed: Sep. 13, 2013

(65) Prior Publication Data

US 2014/0080685 A1 Mar. 20, 2014

Related U.S. Application Data

(60) Provisional application No. 61/701,445, filed on Sep. 14, 2012, provisional application No. 61/784,192, filed on Mar. 14, 2013.

(51) Int. Cl.
*A63B 21/062* (2006.01)
*A63B 26/00* (2006.01)
(Continued)

(52) U.S. Cl.
CPC ..... *A63B 21/062* (2013.01); *A63B 21/00065* (2013.01); *A63B 21/00072* (2013.01);
(Continued)

(58) Field of Classification Search
CPC ... A63B 21/078; A63B 21/1457; A63B 21/16; A63B 21/1453; A63B 2021/1609;
(Continued)

(56) References Cited

U.S. PATENT DOCUMENTS 3,635,472 A 1/1972 Marcyan
3,912,263 A 10/1975 Yatso
(Continued)

OTHER PUBLICATIONS

Plyo Swing—Westside-Barbell.com video, http://www.youtube.com/watch?v=gXE-JTz_PnY, 2 pages, Oct. 27, 2010.
(Continued)

*Primary Examiner* — Nyca T Nguyen
(74) *Attorney, Agent, or Firm* — Harness, Dickey & Pierce, P.L.C.

(57) ABSTRACT

A multifunctional exercise machine includes carriages associated with resistance. Cable arm assemblies are mounted on the machine for use in performing desired exercises using the carriages and/or resistance. At least one of the cable arm assemblies is rotatable in a generally horizontal plane and includes arm segments, where one arm segment is rotatable relative to the other arm segment in a generally vertical plane. The machine also includes a vertically adjustable monolift assembly having arms for supporting a barbell in the machine, where the arms are adjustable between multiple different rotatable positions as well as in a direction generally parallel to longitudinal axes of the arms. A bench is provided that can be docked in the machine, and that includes a telescoping support for providing added stability to the bench when desired. A spotting assembly is also provided for use in catching barbells at desired locations in the machine.

27 Claims, 21 Drawing Sheets

(51) Int. Cl.
*A63B 21/078* (2006.01)
*A63B 23/035* (2006.01)
*A63B 21/072* (2006.01)
*A63B 21/00* (2006.01)

(52) U.S. Cl.
CPC ..... *A63B 21/063* (2015.10); *A63B 21/0628* (2015.10); *A63B 21/0632* (2015.10); *A63B 21/0724* (2013.01); *A63B 21/0783* (2015.10); *A63B 21/154* (2013.01); *A63B 21/4031* (2015.10); *A63B 21/4035* (2015.10); *A63B 23/03558* (2013.01); *A63B 23/03566* (2013.01); *A63B 21/00069* (2013.01); *A63B 2225/09* (2013.01); *A63B 2225/093* (2013.01)

(58) Field of Classification Search
CPC ..... A63B 21/4029; A63B 21/4027; A63B 21/4031; A63B 21/40; A63B 21/1609; A63B 21/06; A63B 22/0087; A47C 9/002
See application file for complete search history.

(56) References Cited

U.S. PATENT DOCUMENTS 3,971,555 A 7/1976 Mahnke
4,093,214 A 6/1978 Coker et al.
4,199,139 A 4/1980 Mahnke et al.
4,200,280 A 4/1980 Goodwin
4,346,888 A 8/1982 Szabo
4,349,192 A 9/1982 Lambert, Jr. et al.
4,635,934 A * 1/1987 Roethke ..... A63B 21/154 482/104
4,691,916 A 9/1987 Voris
4,826,157 A 5/1989 Fitzpatrick
4,836,535 A 6/1989 Pearson
4,875,676 A * 10/1989 Zimmer ..... A63B 21/078 482/104
4,907,798 A 3/1990 Burchatz
4,936,572 A * 6/1990 Desiderio ..... A63B 21/1457 248/291.1
4,974,838 A 12/1990 Sollenberger
5,184,992 A 2/1993 Banks
5,215,510 A 6/1993 Baran
5,290,213 A * 3/1994 Sheikowitz ..... A63B 21/4029 482/104
5,346,448 A * 9/1994 Sollo ..... A63B 21/00181 482/104
5,470,299 A * 11/1995 Yeh ..... A63B 21/156 482/112
5,669,859 A 9/1997 Liggett et al.
5,738,615 A 4/1998 McCollum et al.
6,231,486 B1 5/2001 Lee
6,238,323 B1 5/2001 Simonson
6,264,586 B1 * 7/2001 Webber ..... A63B 21/078 482/104
6,458,061 B2 10/2002 Simonson
6,605,023 B1 * 8/2003 Mobley ..... A63B 21/078 482/142
6,659,923 B2 12/2003 Teuscher
6,712,740 B2 3/2004 Simonson
6,746,379 B1 * 6/2004 Brawner ..... A63B 21/078 482/104
6,770,015 B2 8/2004 Simonson
7,063,649 B2 6/2006 Szultka et al.
7,112,162 B2 9/2006 Greenland
7,147,594 B1 * 12/2006 Vittone ..... A63B 21/078 482/142
7,169,093 B2 1/2007 Simonson et al.
7,601,105 B1 10/2009 Gipson, III et al.
7,641,602 B2 1/2010 Rogers et al.
7,753,830 B1 * 7/2010 Marsh ..... A63B 21/078 482/104
7,837,604 B1 * 11/2010 Hsu ..... A63B 22/0056 482/137
7,909,742 B2 3/2011 Ish, III et al.
7,909,743 B1 3/2011 Webber
8,500,608 B1 8/2013 Bonomi
2003/0050157 A1 * 3/2003 Teuscher ..... A63B 21/00 482/142
2003/0134722 A1 7/2003 Greenland
2005/0032614 A1 * 2/2005 Keiser ..... A63B 21/4029 482/142
2005/0049121 A1 * 3/2005 Dalebout ..... A63B 21/00072 482/93
2007/0155597 A1 * 7/2007 Hockemeyer ..... A63B 21/078 482/99
2007/0161472 A1 7/2007 Drechsler
2007/0179030 A1 8/2007 Slawinski
2007/0270293 A1 * 11/2007 Zhuang ..... A63B 21/023 482/123

OTHER PUBLICATIONS

Rogers Athletic Website, http://www.rogersathletic.com/strength_training/rack_training_attachments/rack_training_attachments.asp?pid=427, 2 pages, printed Jan. 13, 2014.
Max Rack 3-D Smith Machine 30-sec Commercial, http://www.youtube.com/watch?v=9FPZpvj-xWY&feature=related, 2 pages, Aug. 17, 2007.
Power Spot Self Spotting Dumbbell Machine demonstrated with Bowflex dumbbells, http://www.youtube.com/watch?v=8Zf6VQFXjQ4&feature=player_embedded, 3 pages, Nov. 2, 2009.
Power Spot self-spotting barbell and dumbbell Machine, http://www.youtube.com/watch?v=aM_nUd3Bo4U&feature=related, 3 pages, May 27, 2010.
Monolift by Irondawg Power, http://www.irondawg.com/monolift_by_irondawg_power.htm, 5 pages, printed Mar. 3, 2014.

* cited by examiner

MULTIFUNCTIONAL EXERCISE MACHINES

CROSS-REFERENCE TO RELATED APPLICATIONS

This application claims the benefit of, and priority to, U.S. Provisional Application No. 61/701,445, filed Sep. 14, 2012, and U.S. Provisional Application No. 61/784,192, filed Mar. 14, 2013. The entire disclosures of each of the above applications are incorporated herein by reference

FIELD

The present disclosure relates generally to exercise machines, and more particularly to multifunctional exercise machines of the type which simulate free weight barbell and dumbbell exercise movements as well as functional training cable exercises.

BACKGROUND

This section provides background information related to the present disclosure which is not necessarily prior art.

Weightlifting machines for simulating barbell exercise movements typically include barbells attached to slide mechanisms that run on vertical guides on opposite sides of a stationary frame. This allows a lifter to perform exercises with vertical up and down movements, such as squats, bench press exercises, and the like, but does not permit any horizontal movements. Other weight lifting machines include cables that allow for moving weights attached to the cables to perform exercises such as push downs, curls, pull downs, rows, etc.

SUMMARY

This section provides a general summary of the disclosure, and is not a comprehensive disclosure of its full scope or all of its features.

Example embodiments of the present disclosure are generally directed toward multifunctional exercise machines. In one example embodiment, a machine generally includes a resistance (e.g., at least one stack of weights, etc.). In another example embodiment, the machine may also (or alternatively) include at least one carriage associated with the resistance. In another example embodiment, the machine may also (or alternatively) include at least one cable arm assembly. In some aspects, the at least one cable arm assembly is rotatable in a generally horizontal plane, where the at least one cable arm assembly includes a first arm segment and a second arm segment, and where the second arm segment is rotatable relative to the first arm segment in a generally vertical plane. In another example embodiment, the machine may also (or alternatively) include a monolift assembly moveable in a generally vertical direction, where the monolift assembly includes first and second arms, and where the first and second arms are both adjustable in a direction generally parallel to longitudinal axes of the first and second arms. In another example embodiment, the machine may also (or alternatively) include a docking system for releasably coupling a bench to the machine. In another example embodiment, the machine may also (or alternatively) include an adjustable platform.

In another example embodiment, the machine may also (or alternatively) include at least one exercise attachment configured to couple to the machine, where the at least one exercise attachment includes first and second inserts configured to be received into corresponding openings of the machine to thereby couple the at least one exercise attachment to the machine, and where the first insert includes a post and a cap, and the cap is configured to move transverse to a longitudinal axis of the post so that when the post is received through an opening of the machine the cap can slide relative to the post to thereby retain the post in the opening.

In some aspects of the present disclosure, resistance included in example embodiments of machines includes stacks of weights. Here, carriages of the machines may be co-located with the stacks of weights. Or, carriages of the machines may be located separate from the stacks of weights and coupled thereto (so that movement of the carriages then also moves the stacks of weights). In other aspects of the present disclosure, resistance included in example embodiments of machines may include stacks of weights, resistance bands, free weights, combinations thereof, etc.

Example embodiments of the present disclosure are also generally directed toward arm assemblies for use with the multifunctional exercise machines. In one example embodiment, an arm assembly generally includes first and second arm segments, a first adjustment system coupled to the first and second arm segments and operable to allow selective rotation of the second arm segment relative to the first arm segment, and a second adjustment system coupled to the first arm segment and operable to allow selective rotation of the first and second arm segments together.

Example embodiments of the present disclosure are also generally directed toward spotting assemblies for use with the multifunctional exercise machines for use in catching barbells, etc. at desired locations in the multifunctional exercise machine. In one example embodiment, a spotting assembly generally includes at least one adjustable strap system having at least one strap, multiple couplings, and a hook portion configured to be releasably engaged with at least one of the multiple couplings to thereby position the at least one strap at a desired location for catching the barbell in the multifunctional exercise machine.

Example embodiments of the present disclosure are also generally directed toward exercise benches for supporting users when performing exercises, for example, in connection with the multifunctional exercise machines, etc. In one example embodiment an exercise bench generally includes a frame, a seat portion rotatable relative to the frame, a back portion rotatable relative to the frame, a carrier unit supporting the seat portion and the back portion on the frame and moveable relative to the frame for moving the seat portion and the back portion in a longitudinal direction relative to the frame, and a support moveably coupled to the frame and disposed generally below the back portion and/or the seat portion. The support is moveable relative to the frame in the longitudinal direction of the frame to thereby extend longitudinally from the frame, for example, to thereby provide additional stability to the exercise bench when the seat portion and the back portion move in the longitudinal direction relative to the frame.

Example embodiments of the present disclosure are also generally directed toward monolift assemblies for use with the multifunctional exercise machines. In one example embodiment, a monolift assembly generally includes a frame, at least one guide post supporting the frame, at least one receptacle coupled to the frame and configured to couple an arm to the frame for use in supporting a barbell in a multifunctional exercise machine, a first adjustment system coupled to the frame and operable to rotate the at least one receptacle relative to the at least one guide post to thereby position the at least one receptacle in one of multiple different rotational positions relative to the at least one guide post, and at least one second adjustment system operable to couple the frame to the at least one guide post at one of multiple different positions along the at least one guide post and to allow movement of the frame in a generally longitudinal direction along the at least one guide post between the multiple different positions.

Example embodiments of the present disclosure are also generally directed toward carriage assemblies for use with the multifunctional exercise machines. In one example embodiment, a carriage assembly generally includes a carriage, at least one guide rod for supporting sliding movement of the carriage, and a selector post for supporting the carriage at different desired locations along the at least one guide rod and configured to couple to a resistance of a multifunctional exercise machine so that movement of the selector post correspondingly moves at least part of the resistance of the multifunctional exercise machine. The carriage includes an adjustment system moveable between a first position in which the adjustment system couples the carriage to the selector post at one of the different desired locations along the selector post so that movement of the carriage corresponding moves the selector post and at least part of the resistance of the multifunctional exercise machine, and a second position in which the adjustment system uncouples the carriage from the selector post so that the carriage is moveable relative to the selector post and independent of the resistance of the multifunctional exercise machine. In some aspects of the example carriage assembly, the carriage may further include (additionally or alternatively) at least one mount for coupling one or more of free weights, resistance bands, and chains to the carriage. In some aspects of the example carriage assembly, the carriage may further include (additionally or alternatively) an attachment portion for use in coupling at least one exercise attachment to the carriage, the attachment portion having multiple channels extending therethrough for use in coupling the at least one exercise attachment to the carriage. In some aspects of the example carriage assembly, the carriage may further include (additionally or alternatively) a unit configured to slidably couple the carriage to the at least one guide rod and support the sliding movement of the carriage along the at least one guide rod. In some aspects, the unit may comprise ball bearings for supporting the sliding movement of the carriage along the at least one guide rod. In some aspects of the example carriage assembly, the adjustment system of the carriage may include a pin and a retainer, where the pin is configured to releasably position within an opening of the of the selector post in the first position of the adjustment system to thereby couple the carriage to the selector post at a desired location along the selector post and where the retainer is configured to hold the pin out of the opening of the selector post in the second position of the adjustment system to thereby uncouple the carriage from the selector post. In some aspects of the example carriage assembly, the at least one guide rod includes two guide rods.

Example embodiments of the present disclosure also generally relate to exercise attachments for use with the multifunctional exercise machines. In one example embodiment, an exercise attachment generally includes first and second inserts configured to be received into corresponding openings of a component of a multifunctional exercise machine (e.g., a carriage, an arm, etc.) to thereby couple the exercise attachment to the carriage. The first insert includes a post and a cap, where the cap is configured to move in a direction generally transverse to a longitudinal axis of the post so that when the post is received through its corresponding opening the cap can slide relative to the post to thereby retain the post in the opening.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

FIGS. 1-19B illustrate an example embodiment of a multifunctional exercise machine 100 including one or more aspects of the present disclosure. The machine 100 can be used for performing various different exercises including, for example, chest movements, back movements, arm movements, leg movements, etc. In various aspects, the machine 100 enables three-dimensional (forward/backward and upward/downward) exercise movements, via use of various strength training/stretching/exercise attachments, devices, cabling systems, etc. with the machine 100, that can produce efficient resistant training results.

Figure 1:
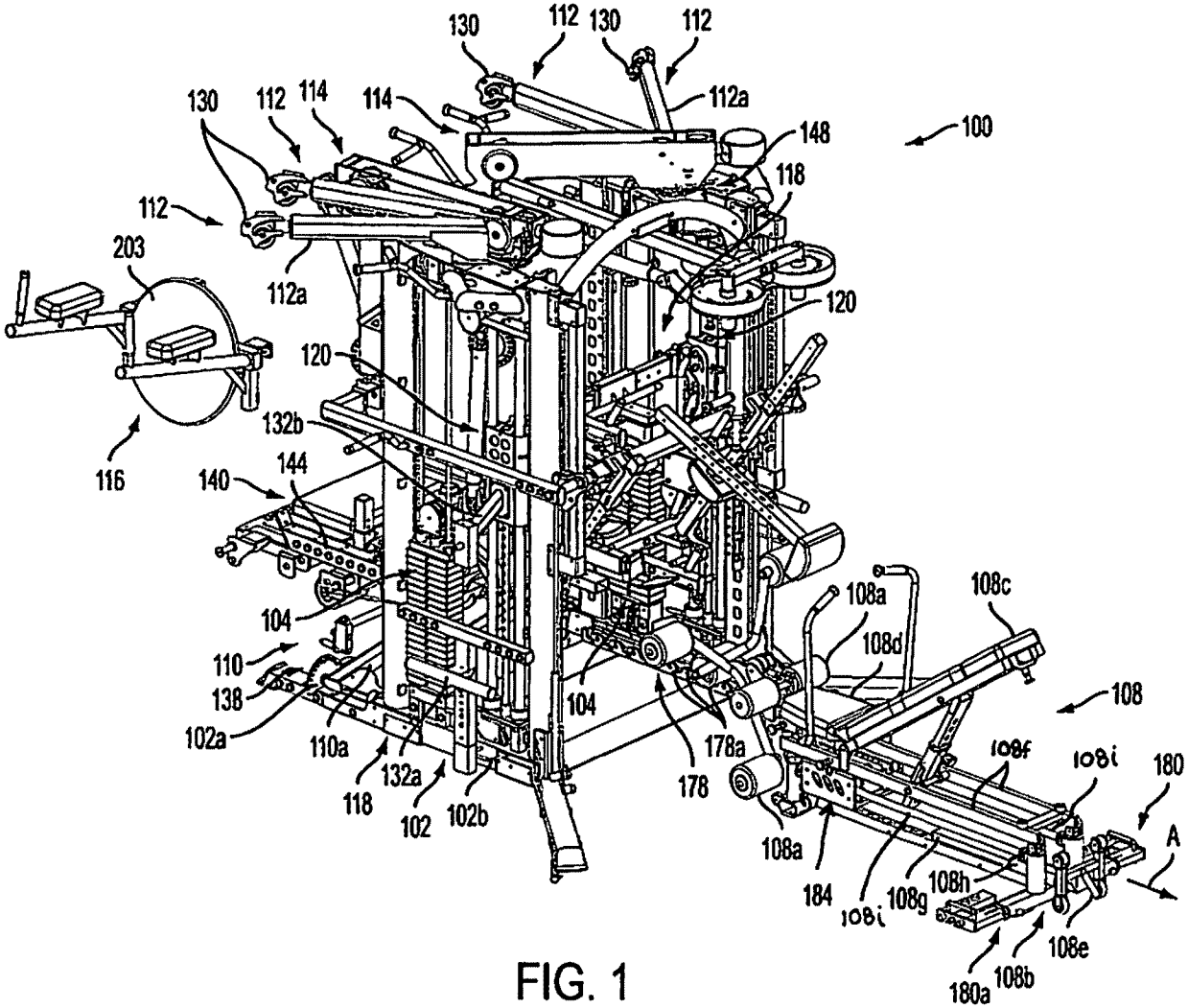
FIG. 1 is a perspective view of an example embodiment of a multifunctional exercise machine of the present disclosure.
Figure 2:
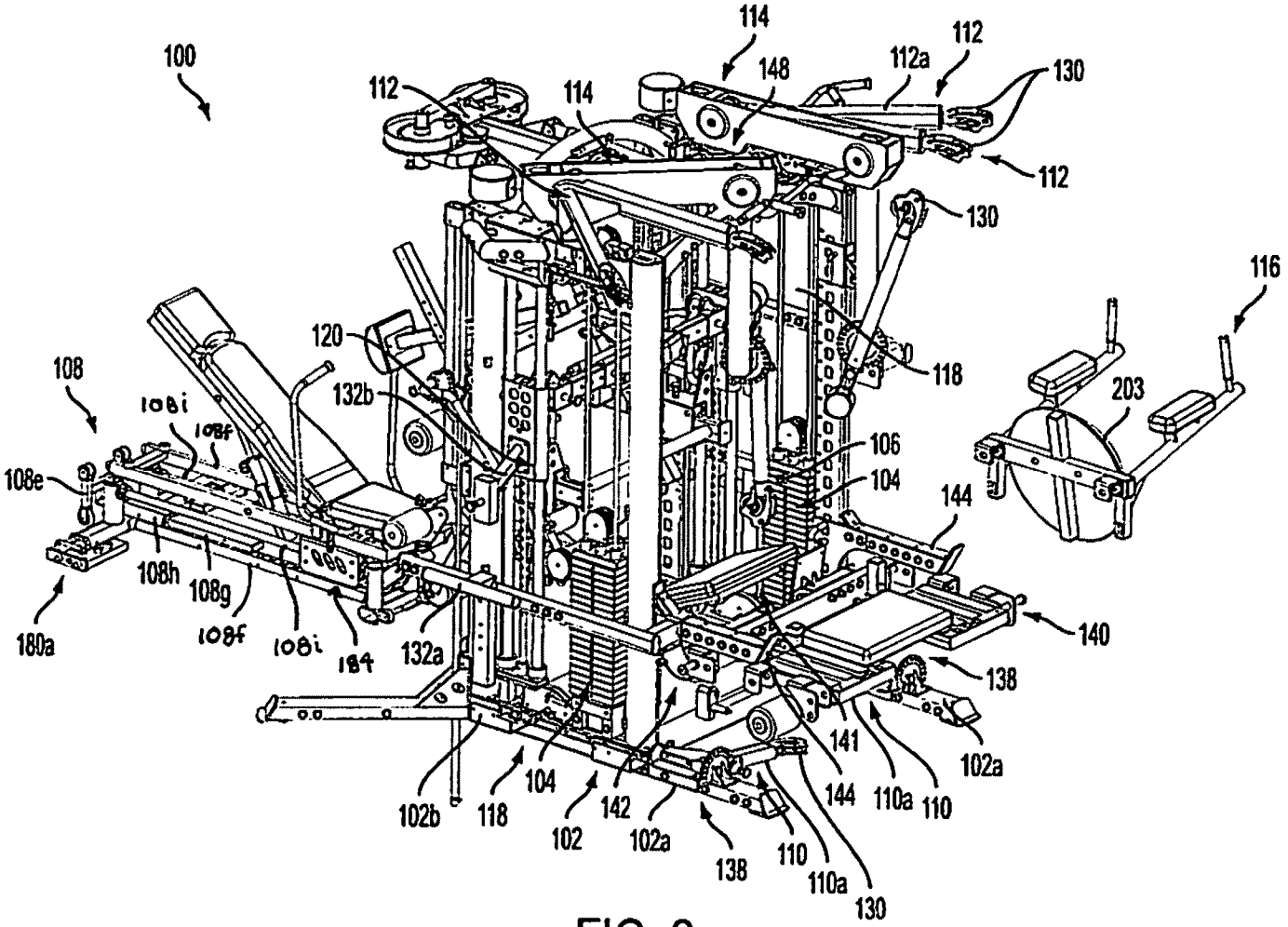
FIG. 2 is another perspective view of the exercise machine of FIG. 1.

As shown in FIGS. 1 and 2, the machine 100 includes a frame 102 supporting various components for use in performing the various different exercises. For example, in the illustrated embodiment, a pair of weight stacks (each indicated at reference number 104) (broadly, resistances) are provided on opposite sides of the frame 102, each having multiple individually selectable weight plates (via a selector pin 106 (FIG. 2), or other suitable structure, etc.), for providing resistance (although, in other example embodiments, resistance can be derived from other numbers of weight stacks (e.g., one weight stack, etc.), from features other than weight stacks (e.g., bands, friction based resistance features, body weight, chains, etc.). An adjustable (and removeable) exercise bench 108 is provided for use in performing chest movements (e.g., chest presses, etc.), press movements, leg movements, other movements, etc. using the weight stacks 104. Padded supports 108*a* are provided on the exercise bench 108 for use in performing leg movements (e.g., leg extensions, leg curls, etc.) using the weight stacks 104. Various articulating cable arm assemblies 110, 112, 114 are provided for use in performing various body movements (e.g., triceps extensions, cable cross chest exercises, etc.). And, support arms 116 (which can be coupled to the frame 102 of the machine 100) are provided for use in performing various body movements (e.g., dips, pull-ups, abdominal movements, leg raises, etc.). It should be appreciated that this listing of components is only exemplary in nature, and that additional components (for use in performing additional exercises) are clearly illustrated in the drawings and, thus, are within the scope of the present disclosure (even though they are not specifically discussed in this section).

The illustrated machine 100 includes two carriage assemblies (each indicated at reference number 118), each having a height adjustable carriage 120 associated with (and coupled to) one of the weight stacks 104. The carriage 120 of each of the carriage assemblies 118 (and their associated weight stacks 104) can be operated independently of each other (e.g., allowing dumbbell type exercise to be performed in the machine 100, etc.), or they can be operated in sync together (e.g., allowing barbell type exercises to be performed in the machine 100, etc.).

Figure 3:
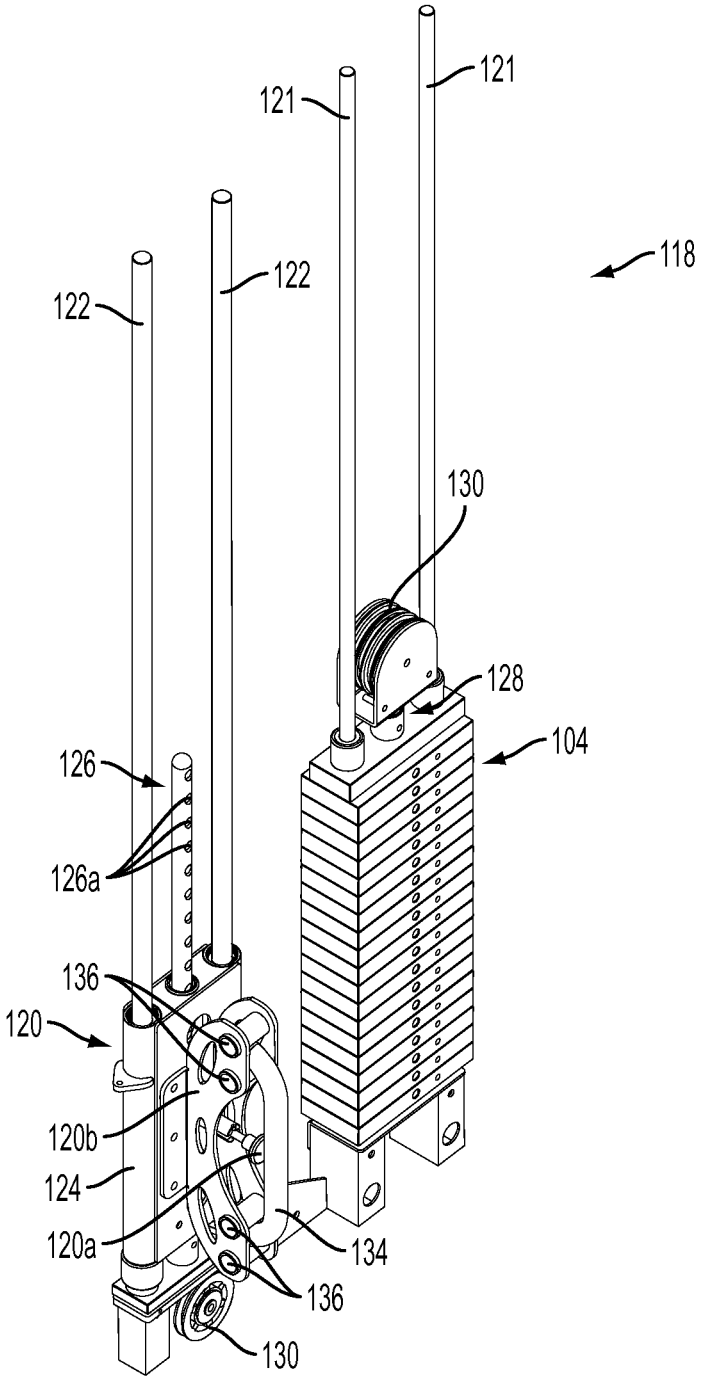
FIG. 3 is a fragmentary perspective view of the exercise machine of FIG. 1 illustrating a weight stack and carriage of the exercise machine.
Figure 4:
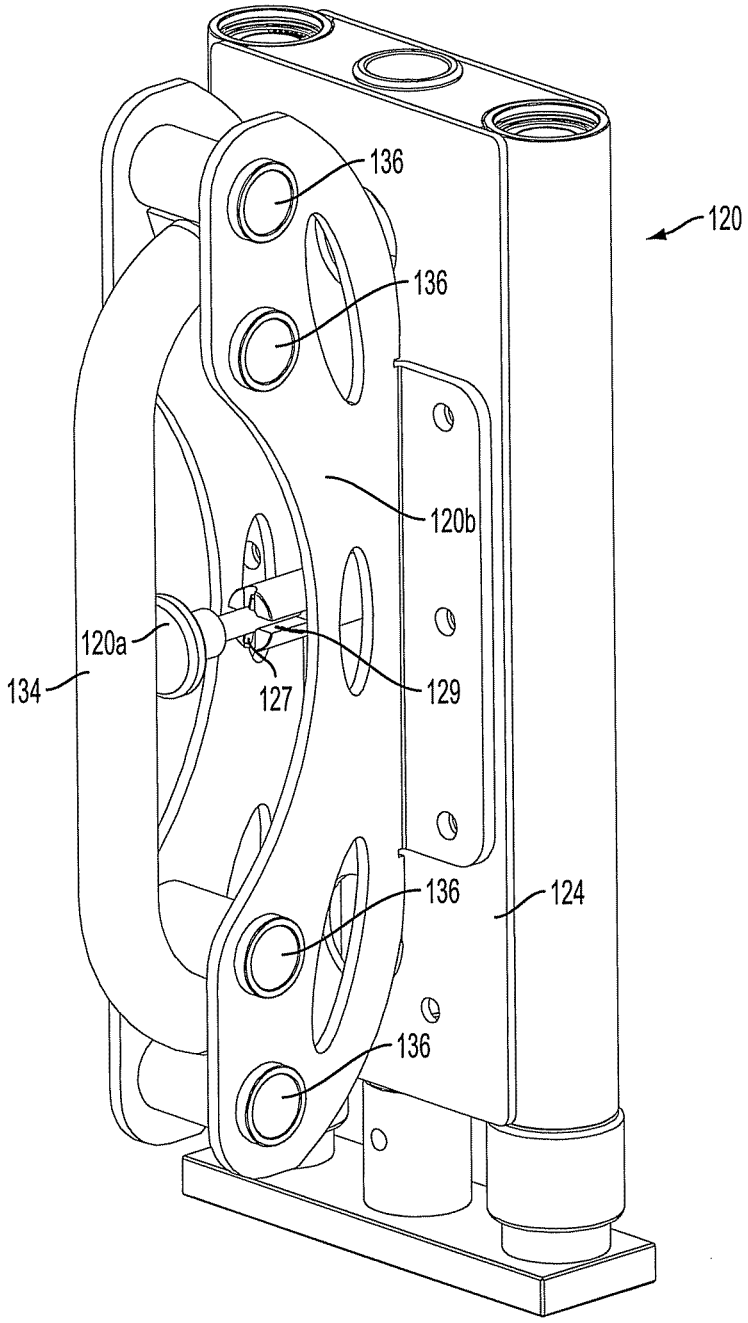
FIG. 4 is an enlarged perspective view of the carriage of the exercise machine.

With reference to FIGS. 3 and 4, one carriage assembly 118, including its carriage 120 and associated weight stack 104, will be described with it understood that a description of the other carriage assembly 118 is substantially the same. The weight stack 104 includes multiple weight plates coupled to a pair of guide rods (each indicate at reference number 121) associated with the frame 102 of the machine 100. The carriage 120 is also coupled to a pair of vertical guide rods (each indicated at reference number 122), each associated with (e.g., couple to, etc.) the frame 102 of the machine 100. The carriage 120 includes a unit 124 that guides movement of the carriage 120 upwardly and downwardly (e.g., in a direction generally parallel to a longitudinal axis of the unit 124, etc.) on/over the guide rods 122 (e.g., with the guide rods 122 received generally through corresponding openings/channels of the unit 124, etc.). Suitable components (e.g., ball bearings, rollers, etc.) may be included in the unit 124 to facilitate the movement of the unit 124 relative to the guide rods 122.

As shown in FIG. 3, an upright selector post 126 of the carriage assembly 118 is provided for use with the carriage 120 and is moveable with the carriage 120 upwardly and downwardly as desired. A pin 120*a* (e.g., a spring loaded plunger type pull pin, etc.) (broadly, an adjustment system) is provided for selectively coupling the carriage 120 to the selector post 126 (e.g., via engagement of the pin 120*a* in apertures, openings, etc. formed in the selector post 126, etc.), at a desired location (e.g., height, elevation, etc.) along the selector post 126. In particular, in FIG. 3 the pin 120*a* is shown as being positionable within one of the holes 126*a* in the selector post 126. The location of the carriage 120 along the selector post 126 can thus be adjusted, as desired, by moving the pin 120*a* to uncouple the carriage 120 from the selector post 126 (e.g., moving the pin 120*a* out of a hole 126*a* of the selector post 126, etc.), sliding the carriage 120 to a new location along the selector post 126, and then moving the pin 120*a* to recouple the carriage 120 to the selector post 126 (e.g., moving the pin 120*a* into another hole 126*a* of the selector post 126, etc.). As such, in the illustrated embodiment, the carriage 120 can be quickly and easily located (via the selector post 126) at any one of a plurality of different heights, for example, for use in performing different exercises, for accommodating different sizes of lifters, etc. (see, e.g., FIGS. 1 and 2 where the carriages 120 are located toward upper portions of the selector posts 126, etc.).

The weight stack 104 is located adjacent the carriage 120 with which it is associated. A second selector post 128 is provided for use with the weight stack 104. The second selector post 128 extends through the weight plates (e.g., through central openings of the weight plates, etc.) of the weight stack 104. The pin 106 (FIG. 2) is provided for selecting the desired weight plates (e.g., for inserting under a select one of the weight plates and into engagement with the second selector post 128 (e.g., through an opening in the second selector post 128, through notches in the second selector post 128, etc.), etc.) to thereby allow for movement of the select one of the weight plates (and all weight plates there above) together with the second selector post 128. Further, the pin 106 can be selectively removed and reinserted under different ones of the weight plates (into engagement with the selector post 128 at corresponding elevations along the selector post 128) so that different numbers of the weight plates can be selected for movement with the carriage 120 (when the carriage is coupled to its selector post 126).

A cable system is associated with the machine 100 for use in coupling (e.g., tethering, etc.) the carriages 120 (via their selector posts 126) and their associated weight stacks 104. For example, with continued reference to FIG. 3, pulleys 130 are coupled to an upper portion of the second selector post 128 and to a lower portion of the selector post 126. And, cables (not shown) extend through the pulleys 130 for use in coupling the carriage 120 (via the selector post 126) to the weight stack 104 (via the second selector post 128). In this arrangement, movement of the carriage 120 (when coupled to the selector post 126) also moves the weight stack 104 (via the cable system). In some aspects of the present disclosure, the cable system may also (or alternatively) be configured to couple the carriage 120 on one side of the machine 100 to the weight stack 104 on the opposing side of the machine 100. For example, in this aspect, cables (not shown) can also extend from the carriage 120 (e.g., from the pulleys on the carriage 120, etc.) to the weight stack 104 on the opposing side of the machine 100 (e.g., to pulleys associated with the weight stack 104, etc.). As such, movement of the carriage 120 (e.g., during exercise movements, etc.) can also correspondingly move the weight stack 104 on the opposing side of the machine 100 alone, or in addition to the weight stack 104 adjacent the carriage 120 being moved, to thereby provide additional, different, etc. combinations of resistance to lifters moving the carriage 120.

In some aspects of the present disclosure, the machine 100 may also include mounts 132*a*, 132*b* (FIGS. 1 and 2) coupled to, formed as part of, etc. the carriages 120 for coupling one or more of free weights, resistance bands, and chains to the carriages 120. For example, free weight mounts 132*a* (which can be selectively coupled to the carriages 120) allow additional free weights to be coupled to the carriages 120 as desired (e.g., to provide additional resistance to exercise movements, etc.). And, clip mounts 132*b* allow resistance bands, chains, etc. to be coupled to the carriages 120 as desired. For example, resistance bands may be coupled to a leg 102*a* of the frame 102 (e.g., via a post, etc.) and positioned through a guide 102*b* on the frame, and then coupled to the clip mount 132*b* so that they provide resistance to movement of the carriages 120 as desired.

In addition, in the illustrated carriage 120, a retainer 127 is provided with the pin 120*a* to lock, hold, etc. the pin 120*a* in a position out of the openings of the selector post 126 when desired to allow the carriage 120 to move independently of the selector post 126 (and, thus, also independently of the weight stack 104). For example, when the pin 120*a* is removed from the openings of the selector post 126, it can be rotated to move the retainer 127 out of a channel 129 (FIG. 4) to thereby hold the pin 120*a* out of the openings of the selector post 126. This feature can be applied to any of the adjustment systems herein. In this position, the carriage 120 can be used to perform exercises using resistance coupled to the mounts 132*a*, 132*b*, and independently of the weight stack 104.

The carriage assemblies 118 of the present disclosure allow for iso-lateral movements (using the two carriage assemblies 118) to be performed (as compared to traditional smith machines that utilize a single bar). The carriages 120 of the carriage assemblies 118 of the present disclosure are also height adjustable without needing to unload weight plates from the weight stacks 104. The carriages 120 also provide the ability to add weights externally via the external mounts 132*a*, 132*b* (e.g., free-weight plate(s), dumbbell trays, chains, bands, etc.). Desired attachments can also be coupled to the carriages 120 to allow for performing various different exercises. As an example, pad members 204 (FIG. 17) can be coupled to each of the carriages 120 to allow users to perform assisted pull-ups (where two users can interact with each other assisting or increasing resistance (e.g., as with personal trainers working with clients to push harder, etc.)).

In some aspects, the machine 100 may also include bar portions that slide vertically within the machine 100 for use in performing desired exercise movements. Resistance to such movement can be provided via cables coupling the bar portions to the carriages 120. And, hooks are provided on each of the bar portions to selectively attach the bar portions to the frame 102 of the machine 100 as desired (e.g., at desired heights, etc.). In some aspects, the bar portions can be used independent of each other so that unilateral exercise movements can be performed. In other aspects, the bar portions can be coupled together (e.g., via spring based couplings, etc.) so that bilateral movements can be performed.

With further reference to FIGS. 3 and 4, the carriage 120 also includes an attachment portion 120*b* configured to allow different exercise attachments (e.g., barbells, dumbbells, dip bars, lifting handles, foot plates, shoulder pads, other exercise attachments, etc.) to be coupled to the carriage 120. The illustrated attachment portion 120*b* includes a handle 134 for use in moving the carriage 120 to one of the different desired locations along the selector post 126. The illustrated attachment portion 132 also includes four spaced apart openings 136 (e.g., defined by channels, sleeves, etc.) for use in coupling the exercise attachments to the carriage 120 (as described more hereinafter (e.g., see FIGS. 13 and 14, etc.)). The spaced apart openings 136 of the carriage's attachment portion 132, in combination with the vertical adjustability of the carriage 120 along the selector post 126, allow for quickly and efficiently accommodating different exercises (at different resistance loads), as well as different sizes of lifters. In other example embodiments, exercise machines may include carriages with attachments portions having more than or less than four openings, different arrangements of openings, etc., or with other suitable portions (e.g., features other than openings such as, for example, posts, etc.) configured to couple exercise attachments to the carriages.

In the illustrated machine 100, the cable system associated with the carriage 120 (cables of the system are not shown) can also be used to selectively couple the carriage 120 to various other features of the exercise machine 100. For example, the cable system may include a cable coupled to one or more of the pulleys 130 (and to one or more pulleys 130 disposed on the frame 102 of the machine 100, for example, as part of the arm assemblies 110, 112, 114, etc.) for use in performing different functional cable exercise utilizing the weight stack 104. Here, a desired exercise attachment (e.g., a strait bar for triceps extension exercises, etc.) may be coupled to one end of the cable (e.g., to a free end of the cable, etc.) so that movement of the exercise attachment by a lifter in turn moves the carriage 120 (and the desired weight plates coupled thereto). In other example embodiments, exercise machines may include cable systems that also include cables coupled to one or more pulleys for use with counter balances or counterweights (e.g., incorporated into middle portions of the cable systems, etc.). Here the counterbalances act to counter the weight of carriages of the machines (e.g., effectively zeroing the weight of the carriages, etc.) to make changing locations of the carriages along selector posts easier (thereby making height adjustments and transitions of the carriages easier). In still other example embodiments, exercise machines may include counter balances or counterweights directly coupled to carriages (e.g., via cables, etc.) to offset the weight of the carriages for easy adjustment of the carriages.

With that said, in the illustrated exercise machine 100, resistance is achieved using the weight stacks 104. In other example embodiments, however, exercise machines may include features other than weight stacks for use in achieving resistance. For example, in some example embodiments, resistance may be achieved directly at carriages by using resistance bands, by using separate weight plates attached directly to the carriages, by coupling first carriages to second carriages (e.g., via cables, etc.) with the second carriages then provide the desired resistance (for both the first and second carriages), by using human load/resistance, by using carriage loads, by using combinations thereof, etc.

With reference again to FIGS. 1 and 2, two articulating cable arm assemblies 110 are provided along legs 102*a* of the frame 102 of the machine 100. Arms 110*a* of the assemblies 110 are moveable relative to the legs 102*a* and can be positioned in multiple different rotational positions to allow lifters to perform different exercise movements. Adjustable pin systems 138 (e.g., pull pins, etc.) (broadly, adjustment systems) are provided to secure the arms 110*a* of the assemblies 110 in desired rotational positions. Cables (not visible) are included with each of the arm assemblies 110 for use in providing resistance to a lifter using the arm assemblies 110. In one aspect, the cables generally extend from the carriages 120 (and the weight stacks 104) to the arm assemblies 110 where desired exercise attachments can be coupled to the cables for use in performing desired cable exercise movements. As such, movement of the exercise attachment in turn moves the carriage 120 (and the desired resistance bands, chains, free weights, and/or weight stacks 104 associated therewith). Alternatively, the cables could be coupled directly to the weight stacks 104 (bypassing the carriages 120). Or, the cables could be coupled to free weights (other than those of the weight stacks 104) for providing resistance, or the cables could include resiliently stretchable cables (where ends of the cables are coupled in fixed positions instead of to the carriages 120) for providing resistance. Thus, it should be appreciated that cable resistance in connection with the arm assemblies 110 can be achieved in various different ways including, but not limited to, weights, stretchy bands/cords (either separate from or attached to the carriage 120), human load/resistance, carriage loads, combinations thereof, etc.

The machine 100 also includes a platform 140 on which a lifter can stand or against which a lifter can push to perform various exercises. In the example embodiment, the platform 140 couples to adjustable arms 144, but could couple to other portions of the frame 102 within the scope of the present disclosure. The platform 140 is moveable such that it can be positioned as needed to perform the desired exercises. For example, the platform 140 is moveable vertically along the frame 102 (via the arms 144) so that it can be positioned at a desired height (e.g., to accommodate desired exercises, etc.), and the platform 140 is rotatable between a vertical position and a horizontal position (as shown in FIGS. 1 and 2). An, adjustment system 142 (e.g., pegs, etc.) (FIG. 2) is provided to secure the platform 140 in the desired position (e.g., with pegs fitting into desired openings along the arms 144, etc.). In the vertical position, the platform 140 can be positioned to allow for leg press exercises, etc. to be performed (e.g., a lifter can position the two articulating cable arm assemblies 110 as desired, lay on the exercise bench 108 holding suitable exercise attachments from the assemblies, and then perform leg press movements (e.g., where the exercise bench 108 includes a sliding portion to accommodate movement of the lifter's body relative to the platform 140, etc.), etc.). In the horizontal position, the platform 140 can be positioned to allow for squat exercises, etc. to be performed (e.g., a lifter can position the articulating cable arm assemblies 110 as desired, stand on the platform 140 holding suitable exercise attachments from the assemblies (or wearing suitable exercise attachments from the assemblies (e.g., an exercise belt to which cables of the assemblies are attached, etc.), and then perform squat movements. Alternatively, the platform 140 may be removed from the machine 100 so that further exercise movements may be performed utilizing other features of the machine 100 (e.g., adjustable arms 144 which are configured to support barbells in the machine 100 and/or other features of the machine 100, and are releasably coupled to the frame 102 of the machine 100 and adjustable to desired heights along the frame 102 (via insertion of pins of the arms 144 into generally vertically aligned openings along the frame) of the machine 100 to accommodate different lifter sizes and different exercise movements, etc.). The platform 140 also includes various receptacles that allow additional features to be coupled (e.g., via the connection system illustrated in FIGS. 13 and 14, etc. or in similar fashion to receptacles 159 of monolift assembly 154, etc.) to the platform 140 of the machine 100 (e.g., bars for use in performing dip movements, other attachments, etc.) to allow for performing additional exercise movements.

A multifunctional adjustable support pad 141 is also provided in the machine 100 for supporting users in performing various exercises. An, adjustment system similar to that described hereinafter for multifunctional adjustable footplate attachment 220 (FIG. 19B) (e.g., an adjustable pin and an adjustment disc with openings for selectively receiving the pin in one of the openings, etc.) is used to adjust/lock the adjustable support pad 141 in a plurality of angles for use in performing various exercises (e.g., a horizontal position, a vertical position, an angled position (as shown in FIG. 2), etc.). And, an attachment neck and/or attachment posts are used to couple the pad 141 to the machine 100 (e.g., in one of various vertical positions and/or rotational positions, etc.), bench 108, etc. for further facilitating performing the various exercises (e.g., coupling the pad 141 to vertically adjusted back portion 108*c* of the bench 108 allows for preacher curl exercises to be performed, etc.).

The machine 100 also includes arm assemblies 112. The arm assemblies 112 include arms 112*a* and pulleys 130 disposed toward end portions of the arms 112*a*. Desired exercise attachments can be coupled to cables (not shown) extending from the pulleys 130 to perform various exercise movements. In one aspect, the cables generally extend from the carriages 120 (and the weight stacks 104) to the arm assemblies 112. As such, movement of the exercise attachments in turn moves the carriage 120 (and the desired resistance bands, chains, free weights, and/or weight stacks 104 associated therewith). Alternatively, the cables could be coupled directly to the weight stacks 104 (bypassing the carriages 120). Or, the cables could be coupled to free weights (other than those of the weight stacks 104) for providing resistance, or the cables could include resiliently stretchable cables (where ends of the cables are coupled in fixed positions instead of to the carriages 120) for providing resistance. Thus, it should be appreciated that cable resistance in connection with the arm assemblies 112 can be achieved in various different ways including, but not limited to, weights, stretchy bands/cords (either separate from or attached to the carriage 120), human load/resistance, carriage loads, combinations thereof, etc. In addition, the arm assemblies 112 are rotatable around the frame 102 of the machine 100 to allow a lifter to perform the different cable exercises, for example, around a perimeter of the machine 100, within the machine 100, etc.

The machine further includes articulating arm assemblies 114. The articulating arm assemblies 114 are coupled to an upper portion of the frame 102 of the machine 100 (FIGS.

1 and 2). The arm assemblies 114 are adjustable both horizontally and vertically to allow a lifter to perform different cable exercises, for example, around a perimeter of the machine 100, within the machine 100, at various heights and resistance levels, etc. As will be described hereinafter, the arm assemblies 114 provide unique movement/adjustability so that exercise attachments can be positioned for use in manner that also allows for simultaneous use/movement of free weights without interference from the exercise attachments.

The arm assemblies 114 are pivotally coupled (via a pin 146 (FIGS. 5-7)) to the upper portion of the machine's frame 102 (FIGS. 1 and 2). As such, the arm assemblies 114 can be rotated clockwise, counterclockwise, etc. around the frame 102 to desired horizontal positions. An adjustable pin system 148 (e.g., a pull pin and an adjustment disc with openings for selectively receiving the pull pin, etc.) (FIGS. 1 and 2) and associated linkage 150 (FIGS. 5-7) (broadly, an adjustment system) is provided with each of the arm assemblies 114 to secure each arm assembly 114 in a desired rotational position relative to the machine's frame 102. The linkage 150 allows for operation of the pin system 148 (e.g., via cables, rods, etc. extending through the arm assemblies 114) from a lower position on the arm assemblies 114. With that said, the illustrated machine 100 is shown with two arm assemblies 114 coupled to the frame 102. However, additional arm assemblies 114 (or fewer arm assemblies 114) may be included (e.g., coupled to different locations of the frame 102 as desired, etc.) within the scope of the present disclosure.

Figure 5:
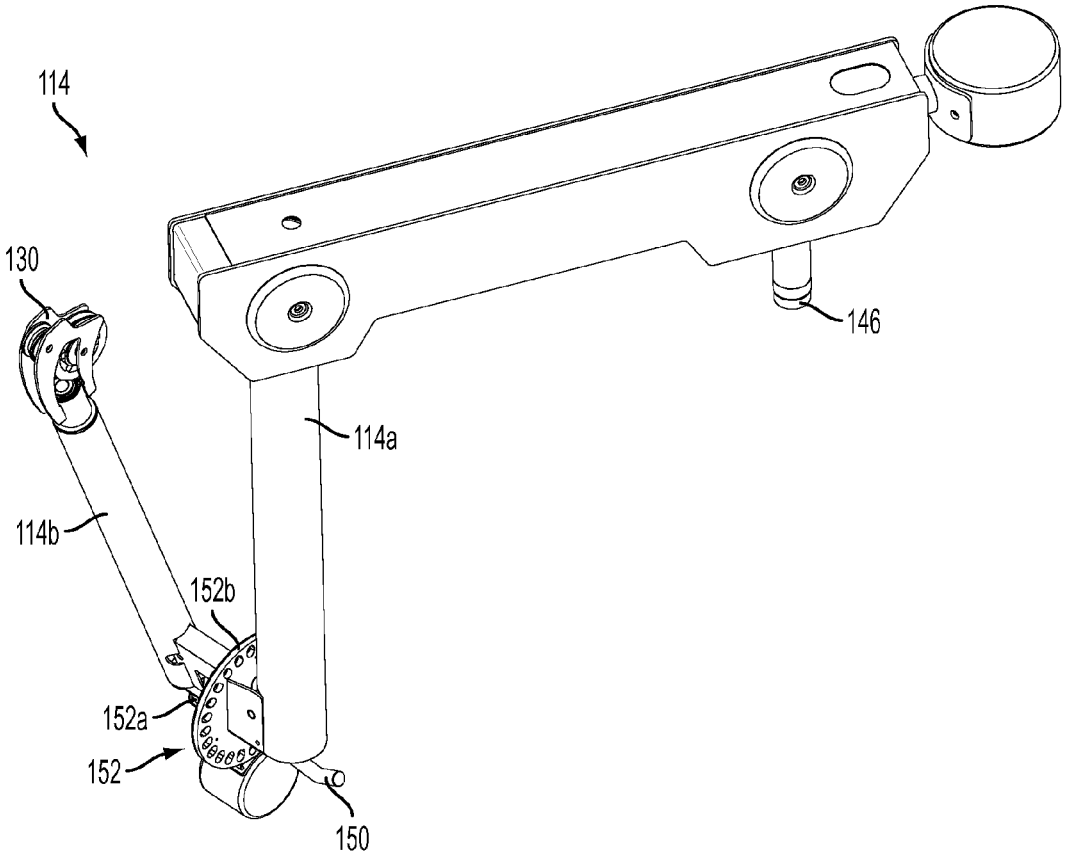
FIG. 5 is a perspective view of an arm assembly of the exercise machine of FIG. 1.
Figure 6:
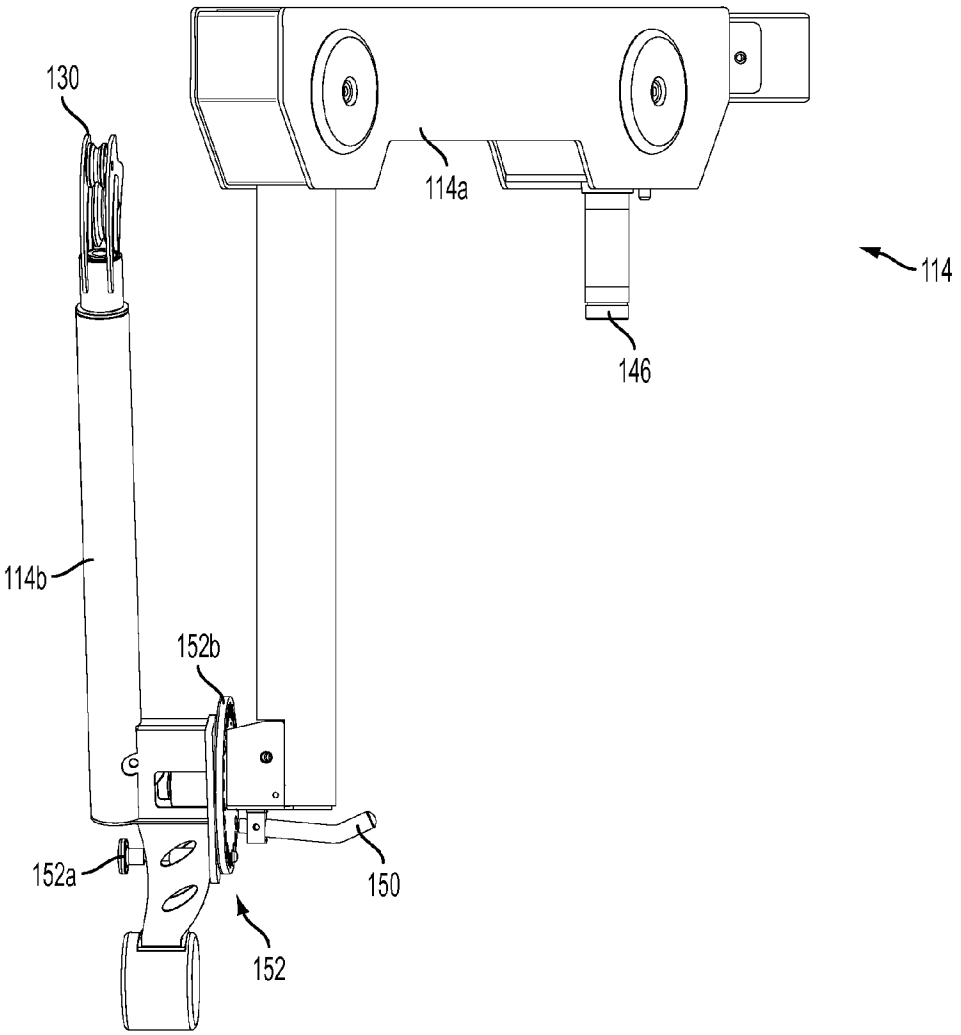
FIG. 6 is a perspective view of the arm assembly of FIG. 5.
Figure 7:
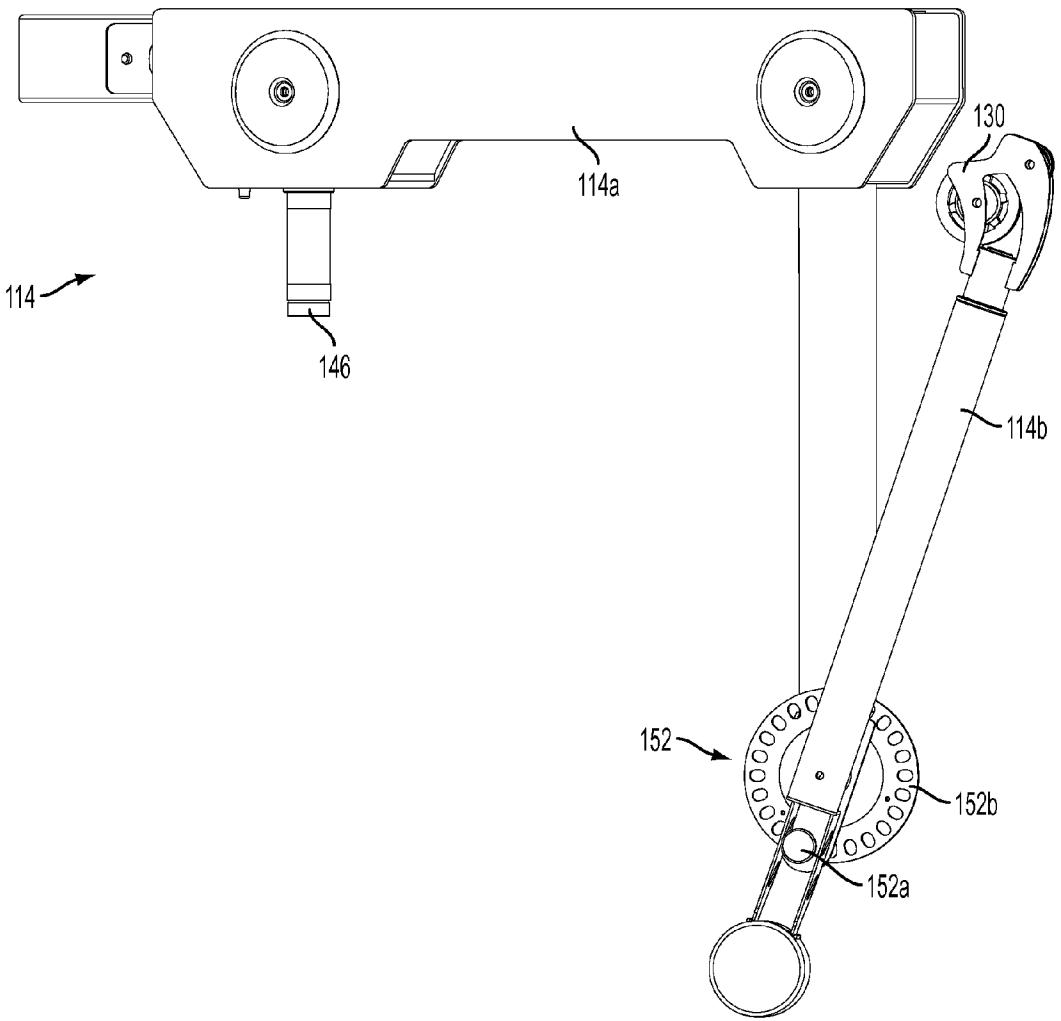
FIG. 7 is another perspective view of the arm assembly of FIG. 5.

With additional reference to FIGS. 5-7, one of the arm assemblies 114 will be further described with it understood that the description applies to both of the arm assemblies 114. The arm assembly 114 includes first and second arm segments 114*a*, 114*b*. The first arm segment 114*a* has a generally L-shape with an upper portion oriented generally horizontally and a lower portion oriented generally vertically; and the second segment 114*b* is generally straight and includes a rotatable pulley 130 located toward a free end thereof (e.g., rotatable about a longitudinal axis of the second segment 114*b*, etc.). The second arm segment 114*b* is rotatable relative to the first arm segment 114*a* and can rotate 360 degrees relative to the first arm segment 114*a*. As such, the second arm segment 114*b* can be positioned in multiple different rotational and vertical positions relative to the first arm segment 114*a* (and relative to the machine 100) for accommodating different exercise movements and/or different resistances. An adjustable pin system 152 (e.g., a pull pin 152*a* and an adjustment disc 152*b* with openings for selectively receiving the pull pin 152*a*, etc.) (broadly, an adjustment system) is provided to secure the second arm segment 114*b* in a desired vertical (rotational) position relative to the first arm segment 114*a*. In other example embodiments, exercise machines may include articulating arm assemblies with more than or less than two arm segments, and/or articulating arm assemblies with segments oriented differently than disclosed herein.

A cable (not visible) is provided with the arm assembly 114 for use in providing resistance to a lifter using the arm assembly 114 to perform an exercise. The cable extends through the first and second arm segments 114*a*, 114*b* of the arm assembly 114. A first end portion of the cable extends out of the free end of the second arm segment 114*b* (at the pulley 130) where desired exercise attachments can be coupled to the cable for use in performing cable exercises. In the illustrated embodiment, a second end portion of the cable is then coupled to the pulley 130 of the carriage 120 (and pulley 130 of the associated weight stack 104) so that movement of the exercise attachment in turn moves the carriage 120 (and the associated weight stack 104, resistance bands, chains, free weights, etc.). Alternatively (or additionally), the second end portion of the cable could be coupled to free weights other than those of the weight stack 104, such that movement of the exercise attachment in turn moves the free weights. Alternatively (or additionally), the cable may include a resiliently stretchable cable where the second end portion is coupled in a fixed position (e.g., to the frame 102 of the machine 100, to the floor, etc.), such that movement of the exercise attachment resiliently stretches the cable. Thus, it should be appreciated that cable resistance in connection with the arm assembly can be achieved in various different ways including, but not limited to, weights, stretchy bands/cords (either separate from or attached to the carriage 120), human load/resistance, carriage loads, combinations thereof, etc.

It should now be appreciated that the first and second arm segments 114*a*, 114*b* of the arm assembly 114, combined, can supply multiple different cable feeding positions to a lifter (particularly compared to prior art machines which typically allow for only vertical adjustment of exercise attachments). In addition, the location of the arm assembly 114 (on the upper portion of the frame 102) and the rotatability of the arm assembly 114 can allow exercises to take place on the front or back of the frame 102. Further, the adjustable pin systems 148, 152 of the arm assembly (which allow for horizontal and vertical adjustment) are positioned in constant locations, and do not move when locations of exercise attachments are moved (as often occurs in prior art machines). Moreover, the adjustable pin systems 148, 152 are positioned lower to the ground in the illustrated machine 100 (as compared to prior art machines) to provide generally easy access to all lifters including, for example, shorter lifters, lifters in wheelchairs, etc.

FIGS. 8-11 illustrate a height adjustable monolift assembly 154 of the machine 100. The monolift assembly 154 can be used to support a barbell within the machine 100 at different locations (e.g., at different vertical locations, at different horizontal locations, etc.). As such, the monolift assembly 154 can be used by different lifters in performing different exercise movements within the machine 100, for example, squat movements, bench-press movements (e.g., flat press movements, incline press movements, decline press movements, etc.), etc.

The monolift assembly 154 includes first and second arms (each indicated at reference number 156) coupled to a frame member 158 (via receptacles 159) and oriented generally parallel to each other. Hooks 160 are provided at end portions of the arms 156 for supporting a barbell in the machine 100. The arms 156 are adjustable in multiple different directions to accommodate different lifters, to allow for performing different exercise movements, etc. For example, the arms 156 of the monolift assembly 154 (coupled to frame member 158) can move vertically upward and downward along guide posts 162 to thereby adjust a vertical height of the monolift assembly 154 in the machine 100 (and a vertical position of the arms 156). Adjustable pin systems 164 (e.g., pull pins 164*a*, etc.) (broadly, adjustment systems) are provided to secure the arms 156 in a desired vertical position along the guide posts 162 (e.g., with the pull pins 164*a* fitting into desired openings along the guide posts 162, etc.). In addition, the arms 156 of the monolift assembly 154 can move relative to the frame member 158 (e.g., perpendicular to the frame member 158 through the receptacles 159, etc.), for example, to adjust a positioning of the hooks within the machine 100, etc. Again, adjustable pin systems 166 (e.g., pull pins 166*a*, etc.) (broadly, and adjustment system) are provided to secure the arms 156 (in conjunction with the receptacles 159) in the desired positions (e.g., with the pull pins 166*a* fitting into desired openings along the arms 156, etc.). Further, the arms 156 (and the receptacles 159) of the monolift assembly 154 can slide toward and away from each other along the frame member 158, as desired, to adjust a lateral spacing between the arms 156 (again, via adjustable pin systems 167 (e.g., pull pins 167*a* and corresponding openings in the frame member 158, etc.) (broadly, adjustment systems)). While two guide posts 162 are provided in the illustrated embodiment, it is contemplated that more or fewer guide posts could be used within the scope of the present disclosure.

Figure 11:
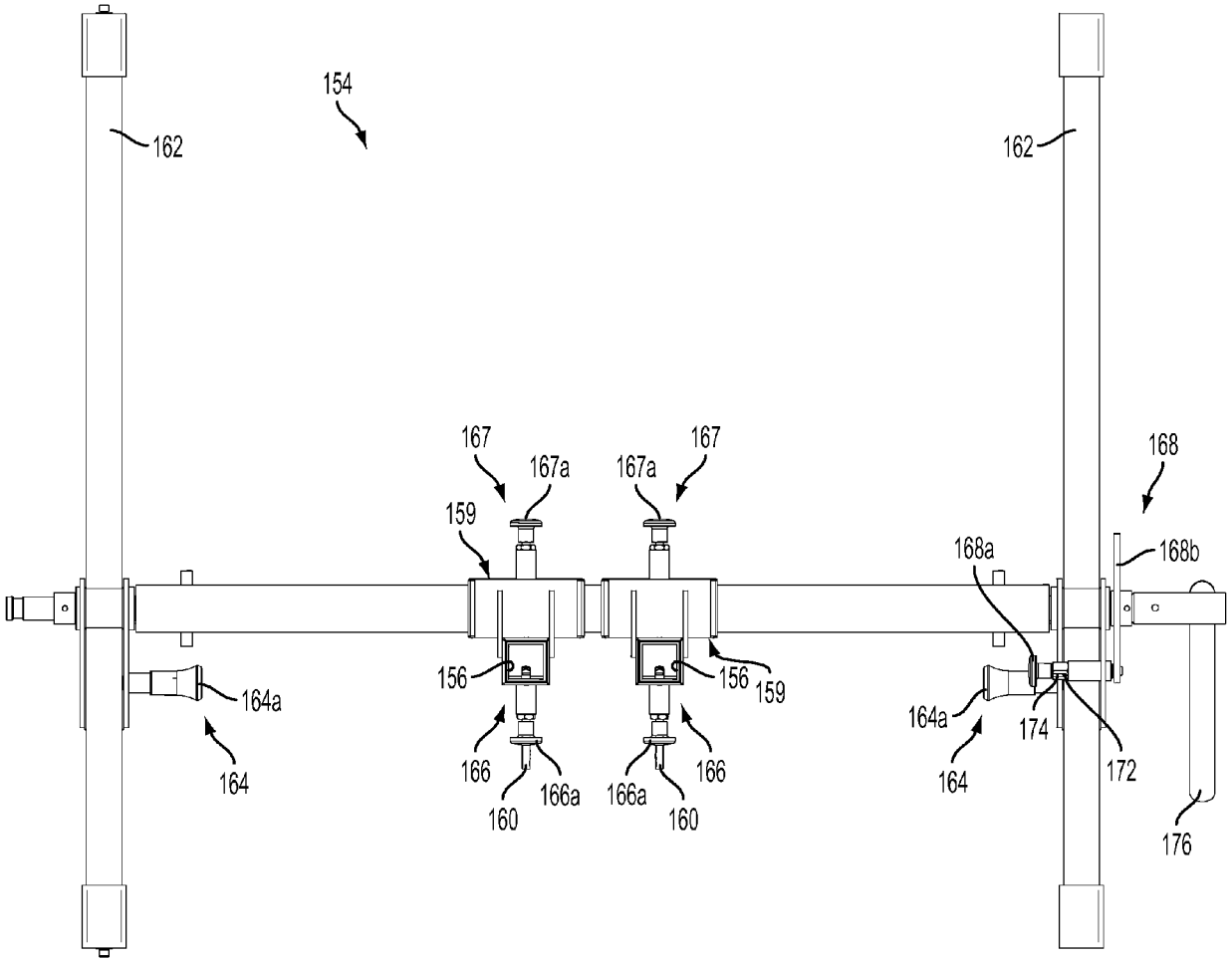
FIG. 11 is another perspective view of the monolift assembly of FIG. 9.

Also in this embodiment, an adjustable pin system 168 (broadly, an adjustment system) is used to position the arms 156 of the monolift assembly 154 at desired rotational angles (or any attachment (e.g., support 170 (FIG. 8), etc.) coupled to the monolift assembly 154 at a desired angle). For example, the arms of the monolift assembly 154 can be rotated to a desired angle, and a spring-biased plunger 168*a* of the pin system 168 can then be inserted into a corresponding opening of a guide plate 168*b* to secure the arms 156 at the desired angle. The plunger 168*a* can then be selectively removed from the opening to allow for further rotation of the arms 156. A retainer 172 is also provided with the plunger 168*a* to lock the plunger 168*a* in a position out of the openings to allow the monolift arms 156 to swing freely when desired (e.g., when the plunger 168*a* is removed from the openings of the guide plate 168*b*, it can be rotated to move the retainer 172 out of a channel 174 to thereby hold the plunger 168*a* out of the openings of the guide plate 168*b*, etc.) (FIG. 11). This feature can be applied to any of the adjustment systems herein.

In use of the monolift assembly 154, the arms 156 are configured to rotate, pivot, etc., between a generally vertical position and a generally horizontal position. For example, the arms 156 are initially positioned in the generally vertical position so that a barbell can be supported on the hooks 160. At the start of the exercise (e.g., at the start of a set, etc.), the lifter raises (vertically) the barbell off the hooks 160 of the arms 156, and the arms 156 are then rotated (via a handle 176 (e.g., a detachable handle, etc.)) to the generally horizontal position, away from the lifer and out of the path of the barbell so that the lifter can perform the exercise (moving the barbell vertically) without interference from the arms 156. At the end of the exercise (e.g., at the end of the set, etc.), the arms 156 are rotated back to the generally vertical position (via the handle 176) so that the lifter can position the barbell back on the hooks 160 of the arms 156 (without walking/moving forward/backward). The adjustable pin system 168 is provided to secure the arms 156 in the generally vertical position and the generally horizontal position when needed. Thus, it can be seen that the monolift assembly 154 provides a safe spotting system for the lifter, as a second person can quickly reposition the arms 156, as needed, back to the generally vertical position for catching the barbell if the lifter begins to fail.

The monolift assembly 154 of the illustrated machine 100 also allows chest press movements to be performed with less stress on shoulder joints. For example, people with shoulder problems often are not able to perform barbell presses as part of doing chest movements because, traditionally, support hooks used for such chest press movements are located in fixed positions, usually upward and behind the lifter. This requires moving the arms and hands above and behind the head to unrack/rack the barbell from the support hooks and, thus, into a position that provides undesired torque on the shoulders (and that may risk injury to the shoulders). In the illustrated machine 100, making use of the monolift assembly 154, the weight (and barbell) are in a safer position, generally centered over the chest of the lifter and lining up with a natural leverage pushing position of the lifter. As such, in the illustrated machine 100, the lifter does not need to put unnecessary torque on his or her shoulders or compromise safety.

With that said, it can be seen that the monolift assembly 154 of the illustrated machine 100 can be used in connection with multiple different exercises, for example, squat movements, chest press movements, etc. In contrast, monolift units of traditional exercise equipment typically allow for performing only one exercise—leg squats (e.g., allowing a lifter to stand straight up with the weight to perform a leg squat instead of lifting weight and walking forward/backward to and from support hooks, such as found on a standard power rack, etc.). What's more, the traditional monolift units are usually only vertically adjustable for very small distances, and are not horizontally adjustable as provided in the illustrated embodiment. Further, the monolift assembly 154 is illustrated with the two arms 156 coupled to the frame member 158 via the receptacles 159. And, it should be appreciated that the arms 156 can be removed from the monolift assembly 154 and interchanged with various different attachments via the receptacles 159 (e.g., support 170 via insertion of support arm 170*b* in one of the receptacles 159, etc.). It should also be appreciated that other example embodiments of monolift assemblies of the present disclosure may include more than or less than two receptacles within the scope of the present disclosure (such that more than or less than two arms, supports, other attachments, etc. can be coupled to frame members of the monolift assemblies).

Figure 12:
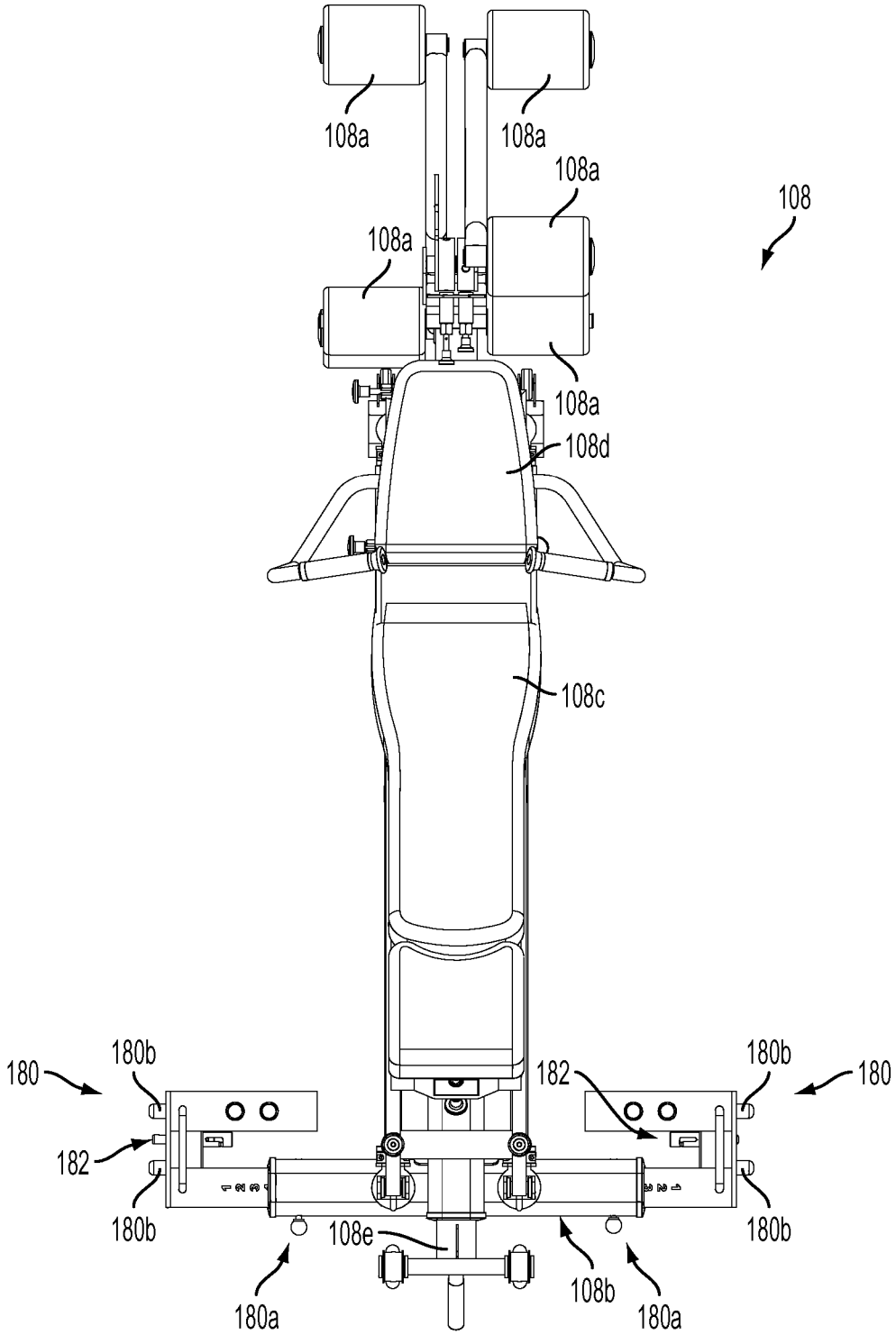
FIG. 12 is a top plan view of a bench of the exercise machine of FIG. 1 and illustrating a docking system for use in coupling the bench to the exercise machine.

FIGS. 1, 2, and 12 illustrate the exercise bench 108 of the machine 100. The illustrated exercise bench 108 includes a docking system which can be used for receiving (and securing) the exercise bench 108 (or other feature) into the machine 100. As part of the illustrated docking system, guides 178 (FIG. 1) are mounted generally horizontally along lower portions of the machine's frame 102 (FIG. 1). And, engagement members 180 are releasably coupled to a footing 108*b* (via receptacles, etc.) of the exercise bench 108 (via a releasable attachment system 180*a* using pins, tabs, etc.) for selectively positioning within desired openings 178*a* of the guides 178 (FIG. 1). In particular, the engagement members 180 each include tabs 180*b* that are configured to fit within corresponding ones of the openings 178*a* of the guides 178 to thereby position the exercise bench 108 at a desired location within the machine 100. In addition, the engagement members 180 each include a slidable lock 182 configured to engage the guides 178 and help inhibit unwanted rotation of the exercise bench 108. Further, when coupled to the footing 108*b* of the bench 108, the engagement members 180 are separately adjustable (e.g., can be laterally telescoped, etc.) relative to the footing 108*b* (via the releasable attachment system 180*a* (broadly, an adjustment system)) (e.g., in a direction generally transverse to or lateral to a longitudinal axis of the exercise bench 108 to one of multiple different positions, etc.). This allows for positioning the exercise bench 108 as desired horizontally in the machine 100 (e.g., centering the exercise bench 108 in the machine 100, etc.). What's more, the engagement members 180 can be removed from the exercise bench 108 (e.g., from the footing 108*b* and its corresponding receptacles, etc.) so that other attachments (e.g., standing platforms, etc.) may be coupled in their place, for example, in the same fashion as described for the engagement members 180 (e.g., using the same type of coupling, etc.). When coupled to the footing 108*b* of the bench 108, these other attachments are then also adjustable in a direction generally transverse to the longitudinal axis of the exercise bench 108 (e.g., transversely inwardly and outwardly relative to the bench 108, etc.) such that they can also be positioned in one of multiple different transverse positions relative to the bench 108 (via the releasable attachment system 180*a*) (in similar fashion to the engagement members 180).

The illustrated exercise bench 108 is also adjustable. For example, a back portion 108*c* of the exercise bench 108 can be rotated (via support) to desired angles for use in performing different exercises. Similarly, a seat portion 108*d* of the exercise bench 108 can also be rotated (via support) to desired angles for use in performing different exercises.

In addition, the seat portion 108*d* and back portion 108*c* of the exercise bench 108 can be slid longitudinally along the frame 108*f* of the exercise bench 108 (via carrier unit 184 (e.g., a bearing system with bearings that support movement of the seat portion 108*d* and back portion 108*c* along guide rails 108*i* of the frame 108*f* of the exercise bench 108, a roller system with rollers that support movement of the seat portion 108*d* and back portion 108*c* along the guide rails 108*i* of the frame 108*f* of the exercise bench 108, etc.)) to allow for positioning the seat and back portions 108*d*, 108*c* as desired to perform different exercises, or to allow for performing exercise movements where the user slides back and forth on the exercise bench 108 (slides the seat and back portions 108*d*, 108*c* back and forth, as discussed above), etc. A lock (e.g., a pin provided generally below the seat portion 108*d* configured to secure within an opening in the frame 108*f* of the exercise bench 108, etc.) is provided to secure the seat and back portions 108*d*, 108*c* in place on the frame 108*f* when sliding movement is not desired.

Further, a lower support 108*e* of the exercise bench 108, positioned generally below the back portion 108*c* of the exercise bench 108 in the illustrated embodiment, can be moved relative to the frame 108*f* of the exercise bench 108 (e.g., can be telescoped, can be moved along wheels, can be extended generally longitudinally, etc.) in a generally longitudinal direction of the bench 108 (see arrow A in FIG. 1) to provide additional stability to the exercise bench 108 (with the lower support 108*e* supported generally by the wheels thereon). In particular, a tongue 108*g* of the lower support 108*e* can be extended through a receptacle 108*h* of the frame 108*f* and secured in place as desired (e.g., via pins, friction fits, etc.). The lower support 108*e* can then be retracted in a generally opposite direction to reposition the support 108*e* back in the position generally below the back portion (as shown in FIGS. 1 and 2). As an example, the lower support 108*e* can be extended from the bench 108 to provide additional stability to the bench 108 when the seat portion 108*d* and the back portion 108*c* are sliding longitudinally along the frame 108*f* of the exercise bench 108 (via carrier unit 184). With that said, it should be appreciated that the lower support 108*e* could be configured to extend from the bench 108 in either a rearward direction of the bench (as generally provided in FIGS. 1 and 2) or a forward direction of the bench 108 within the scope of the present disclosure. In the illustrated embodiment, wheels are shown for supporting extending movement of the lower support 108*e*. In other example embodiments, exercise benches may utilize roller systems, ball bearing systems, etc. coupling lower supports to frames of the benches for use in facilitating extending movement of the lower supports relative to the frames of the benches (in place of wheels). What's more, in some aspects, wheels may also be used in conjunction with the lower supports to allow for the extending movement in such example benches.

As can be seen, some aspects of the illustrated exercise bench 108 allow a user to slide into a correct position under whatever the user is lifting and remain centered (via the laterally adjustable docking system, including the adjustable engagement members 180). What's more, the user can easily adjust positioning of the bench 108, for example, without moving the weights, bench 108, etc. by simply adjusting a longitudinal position of the bench 108 by sliding the seat and pack portions 108*d*, 108*c* as needed and a lateral position by adjusting the docking system (e.g., the engagement members 180, etc.). As can be seen, such adjustment can be done without having to move the entire bench 108. The exercise bench 108 is also portable, such that it can be used to perform exercises in the machine 100 or out of the machine 100, or to perform exercises completely independent of the machine 100. Further, the telescoping support 108*e* allows the bench 108 to be supported and effectively longer in length (when the support 108*e* is extended) when desired (e.g., when sliding the seat and back portions 108*d*, 108*c*, etc.), but shorter in length (when the support 108*e* is retracted) when needed (e.g., when moving the bench 108 around, etc.). What's more, when retracted, the support 108*e* is positioned such that the seat and back portions 108*d*, 108*c* engage the support 108*e* when sliding, such that a user is required to extend the support 108*e* when desired to achieve full sliding movement of the seat and back portions 108*d*, 108*c* (such that the set and back portions 108*d*, 108*c* cannot extend to an unsafe position).

Figure 13:
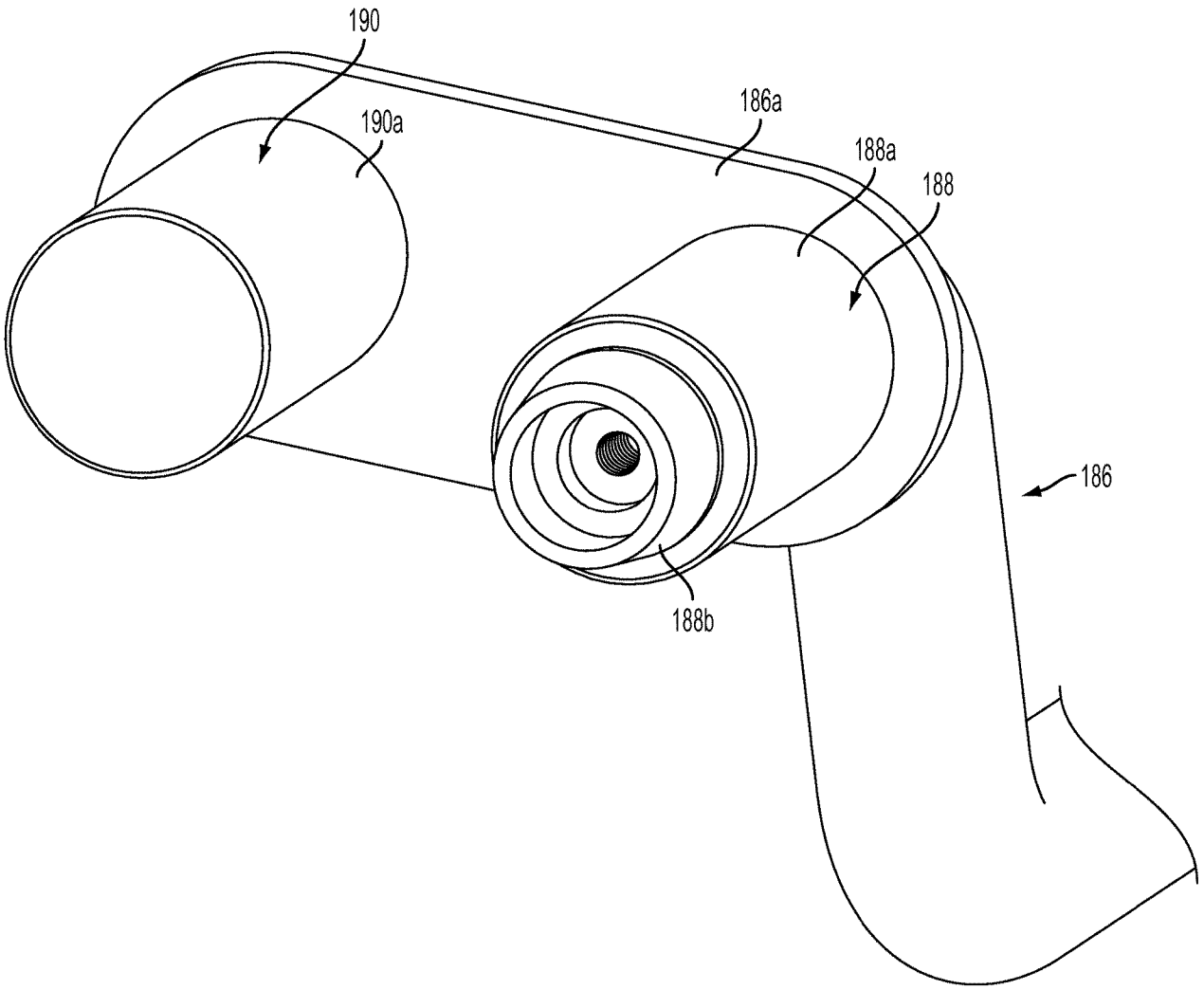
FIG. 13 is a perspective view of a connection system for coupling exercise attachments to the exercise machine of FIG. 1.
Figure 14:
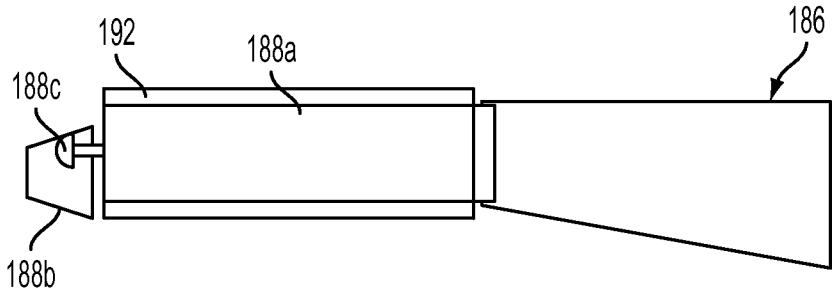
FIG. 14 is a schematic of the connection system of FIG. 13.

With reference now to FIGS. 13 and 14, a unique connection system is provided for coupling exercise attachments to the machine 100 at desired locations on the machine 100. For example, the connection system can be used to couple exercise attachments to the carriage 120 of the machine 100, to support arms 116 on the frame 102 of the machine 100, to other portions of the frame 102 of the machine 100 (e.g., where suitable openings, channels, etc. are provided), etc. In some aspects, the connection system is directly incorporated into different exercise attachments to be used with the machine 100 (see, e.g., FIG. 18, etc.). In other aspects, the connection system is configured to be separately coupled to the exercise attachments to thereby make the exercise attachments compatible with the machine 100 (and to allow for changing the connection system from one exercise attachment to another exercise attachment).

FIG. 13 illustrates a portion of an example exercise attachment 186 incorporating the connection system. The connection system includes first and second inserts 188, 190 supported on a common base 186*a* of the attachment 186 and configured to be received into first and second adjacent openings (e.g., sleeves, etc.) of the machine 100 (e.g., in the frame 102, in the carriage 120, in the arms 144, etc.). The first insert 188 includes a post 188*a* and a tapered cap 188*b* coupled (e.g., via a fastener 188*c* (FIG. 14), etc.) to the post 188*a*. The post 188*a* is sized to extend completely through the first opening (e.g., opening 192 in FIG. 14 which is generally representative of any opening in the machine 100 (e.g., one of the openings 136 in the carriage 120 in FIG. 4, one of the openings in the arms 144, an opening in bar attachment 206, an opening in platform 140, etc.), with the cap 188*b* then projecting out of the opening (FIG. 14). The cap 188*b* is slidable relative to the post 188*a* (and fastener 188*c* (FIG. 14) so that, when the cap 188*b* projects out of the first opening, it moves vertically downward (via gravity) relative to the post 188*a* to thereby lock the attachment in the first opening. The second insert 190 also includes a post 190*a*. The post 190*a* of the second insert 190 is configured to extend at least partially into the adjacent second opening (adjacent the first opening) (e.g., any adjacent opening in the machine 100 (e.g., an adjacent one of the openings 136 in the carriage 120 in FIG. 4, an adjacent one of the openings in the arms 144, an adjacent one of the openings in bar attachment 206, an adjacent one of the openings in platform 140 etc.), etc.) to stabilize the exercise attachment 186 on the machine 100 and help prevent undesired rotation of the exercise attachment 186. To remove the exercise attachment 186 from the machine 100, the cap 188*b* of the first insert 188 is raised to align with the first opening, and the first and second posts 188*a*, 190*a* are then moved out of the first and second openings (e.g., the adjacent openings 136 in the carriage 120 in FIG. 4, the adjacent openings in the arms 144, etc.).

Figure 15:
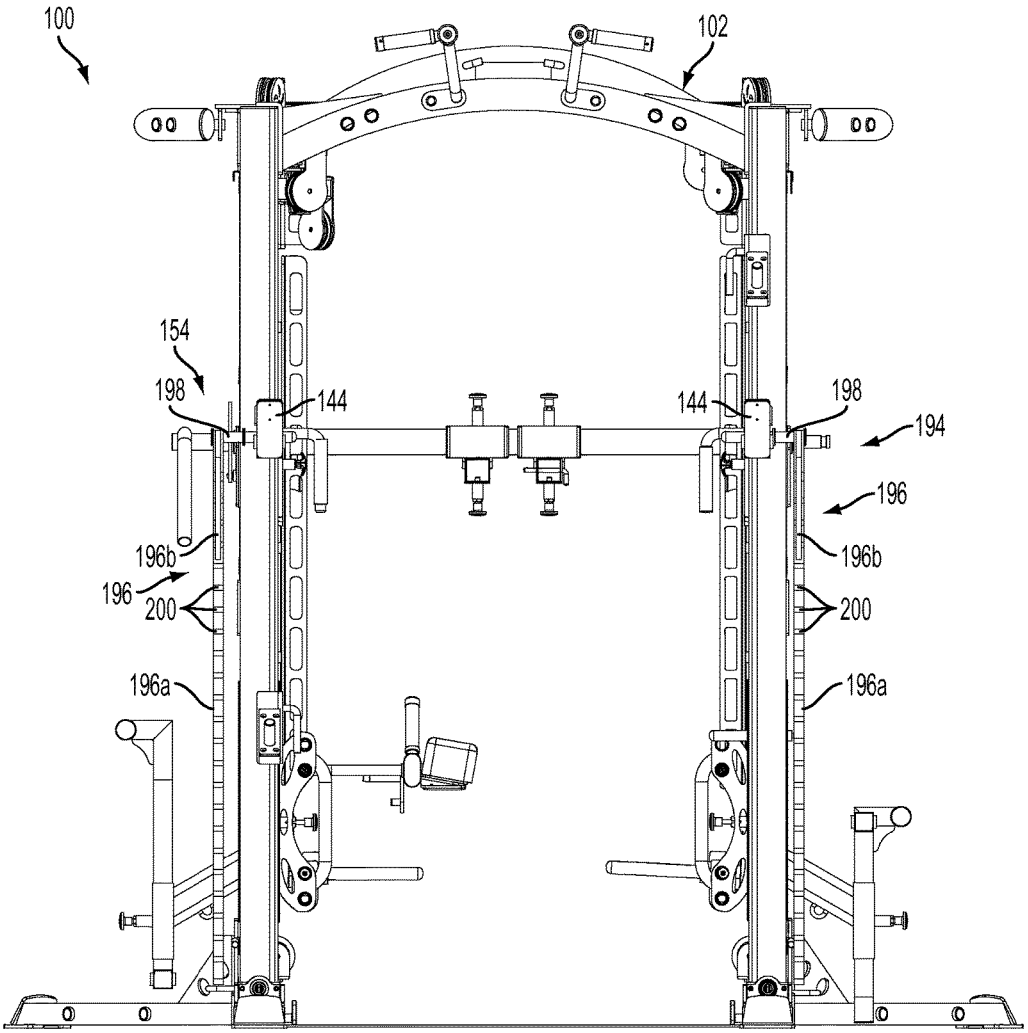
FIG. 15 is a forward elevation view of a spotting assembly of the exercise machine of FIG. 1.
Figure 16:
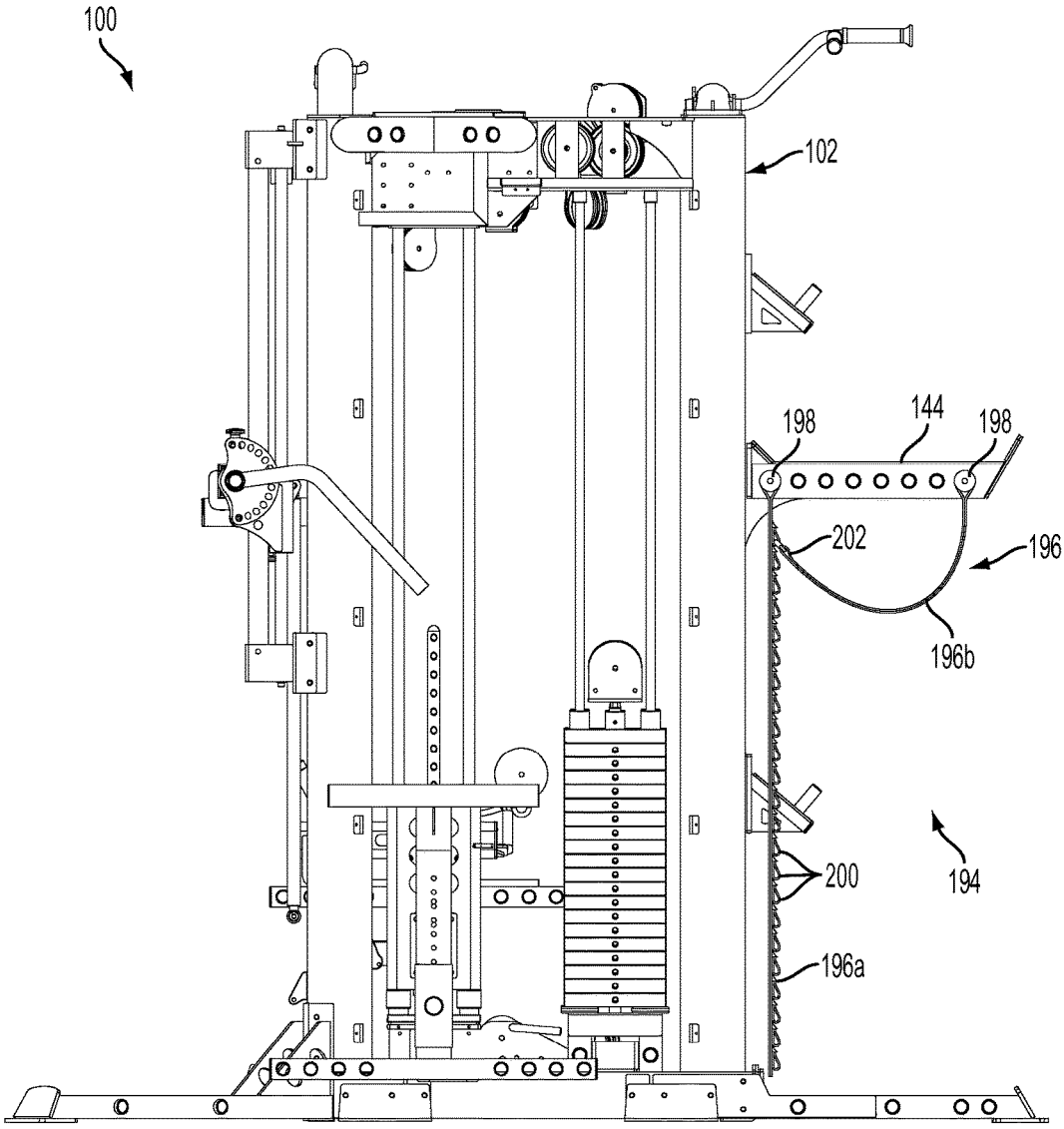
FIG. 16 is a side elevation view of the spotting assembly of FIG. 15.

FIGS. 15 and 16 illustrate an adjustable spotting assembly 194 of the machine 100. The spotting assembly 194 includes strap systems 196 (e.g., for accommodating barbells, etc.) that can be positioned for spotting lifters when performing exercise movements in the machine 100. Posts 198 are provided at desired locations along the horizontally extending arms 144 (e.g., which can be used as safety spotters, which can be used to support other features of the present disclosure, etc.) of the machine 100 (e.g., selectively inserted into openings in the arms 144, etc.). And, straps 196*a*, 196*b* (e.g., nylon straps, chain straps, sets of chains, etc.) are coupled to the posts 198 in a desired orientation (and at a desired length) to provide a catch, support, etc. to spot the lifters when performing exercises. In the illustrated embodiment, each strap system 196 includes two straps 196*a*, 196*b* associated with each of the arms 144. A first strap 196*a* of each strap system 196 includes multiple couplings 200 (e.g., loops (e.g., nylon fabric loops, etc.) sewed into the strap 196*a*, metal rings coupled to the strap 196*a*, hooks coupled to the strap 196*a*, etc.) located along its length. An end portion of a second strap 196*b* can be selectively received by one of the couplings 200 to provide the catch, support, etc. to the lifter. The end portion of the second strap 196*b* can be releasably engaged with any one of the couplings 200 of the first strap 196*a* to allow for adjusting lengths of the strap 196*b* (e.g., in desired increments, etc.) to accommodate desired spotting needs. For example, in the illustrated embodiment the end portion of the second strap 196*b* includes a hook portion 202 that can be positioned in any one of the couplings 200 of the first strap 196*a*. In addition, if needed a length of the first and/or second straps 196*a* and/or 196*b* can be further adjusted (e.g., in smaller increments, etc.) by, for example, coupling the strap 196*a*, 196*b* to one post 198 in one of the arms 144 and then draping it over another post. In other example embodiments, exercise machines may include spotting assemblies with straps capable of coupling to portions of frames of the machines other than arms. With that said, it should be appreciated that other example embodiments of the present disclosure may include spotting assemblies having strap systems that include single straps (instead of or in place of the two straps 196*a*, 196*b* illustrated herein) to provide a catch, support, etc. to spot the lifters when performing exercises. For example, when such a single strap is provided for a strap system, one portion of the single strap may include the couplings 200, another portion of the single strap may couple to a portion of the machine 100 (e.g., to the arms 144 via posts 198, etc.), and another portion of the single strap may include the hook portion 202 for being releasably positioned in a desired one of the couplings 200.

The spotting assembly 194, making use of the arms 144 and posts 198, allows for spotting barbell movements generally outside of the frame 102 of the machine 100. It also allows for performing overhead lifts without hitting the top of the frame 102, quick transitions to other barbell exercises generally outside the rack (e.g., without needing to remove all weights and thread the barbell in/out of the frame 102, as typically required in full rack units, etc.). The machine 100 (which, in some aspects, may be viewed, for example, as a half rack, etc.) also saves space and allows other sides and/or features to be used while one user makes use of the spotting assembly 194. Further, the spotting assembly allows for very small adjustments in spotting height of the assembly 194 (e.g., down to 0.5 inches, etc.), which, for example, can be made while lying on your back or sitting on the bench 108 within a few seconds (as opposed to more time consuming operations of moving entire arms in large increments, as typically done in full rack units). In some aspects, one or more of the strap systems 196 of the spotting assembly 194 can also be used by draping it/them over the monolift assembly 154, for example, to provide an adjustable "safety net" for dropped barbells there as well. In addition, it should be appreciated that the adjustable arms 144 can also be used in a traditional safety spotter manner in the machine 100 (e.g., providing arm protection below the location of the lifted barbell, etc.). Further, making use of the spotting assembly 194 draping from above as well as the arms 144 attached below can provide an additional margin of safety.

As can be seen, a lifter can use the illustrated machine 100 to lift various weights according to his or her ability, either by manipulating various exercise attachments coupled to the machine 100 by pushing/pulling with their hands or by pushing thereon with their feet. In addition, not only can the number of weight plates be regulated to match the lifter's ability but also the height of the carriage 120 (and thus the height of the attachments) can be varied to match the lifter's height and/or to match the exercise being performed. Further, the selector post 126 of the carriage 120 allows for quick and efficient adjustment of the carriage, without the need of auxiliary connecting elements.

Figure 8:
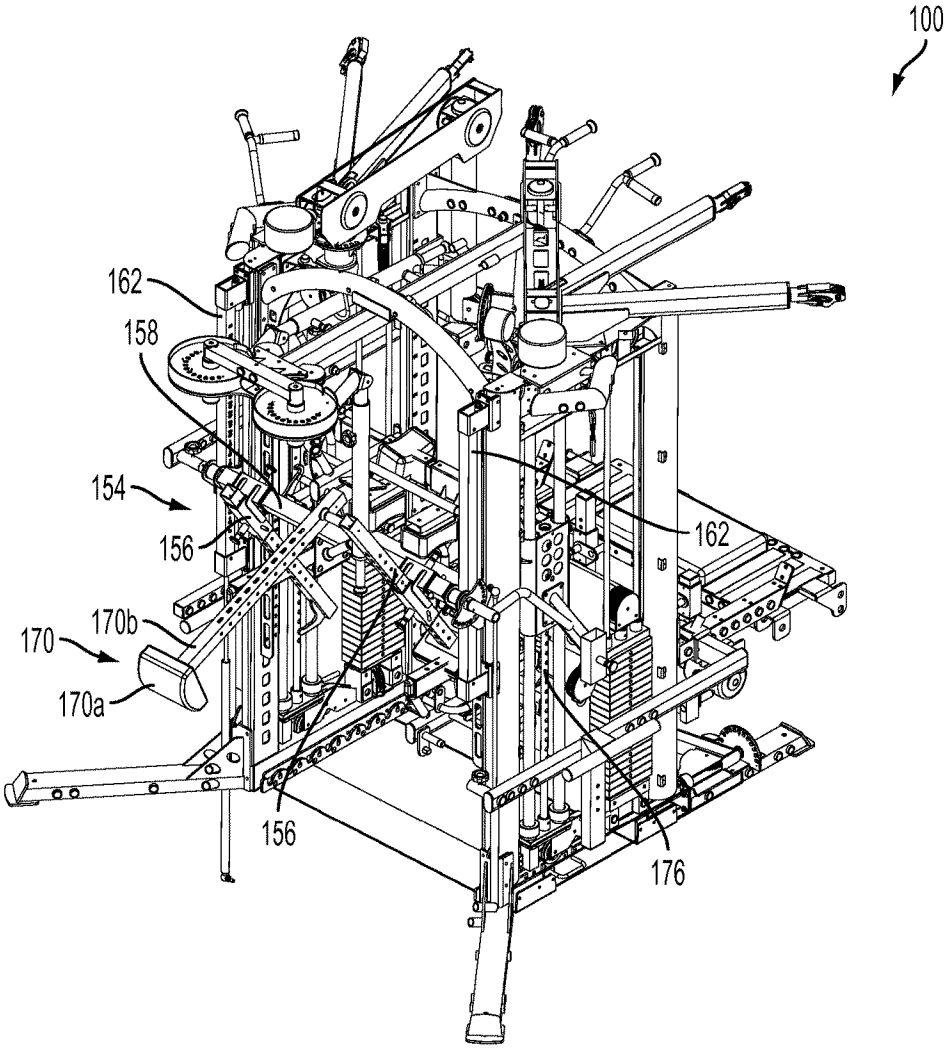
FIG. 8 is another perspective view of the exercise machine of FIG. 1 illustrating a monolift assembly of the exercise machine.
Figure 9:
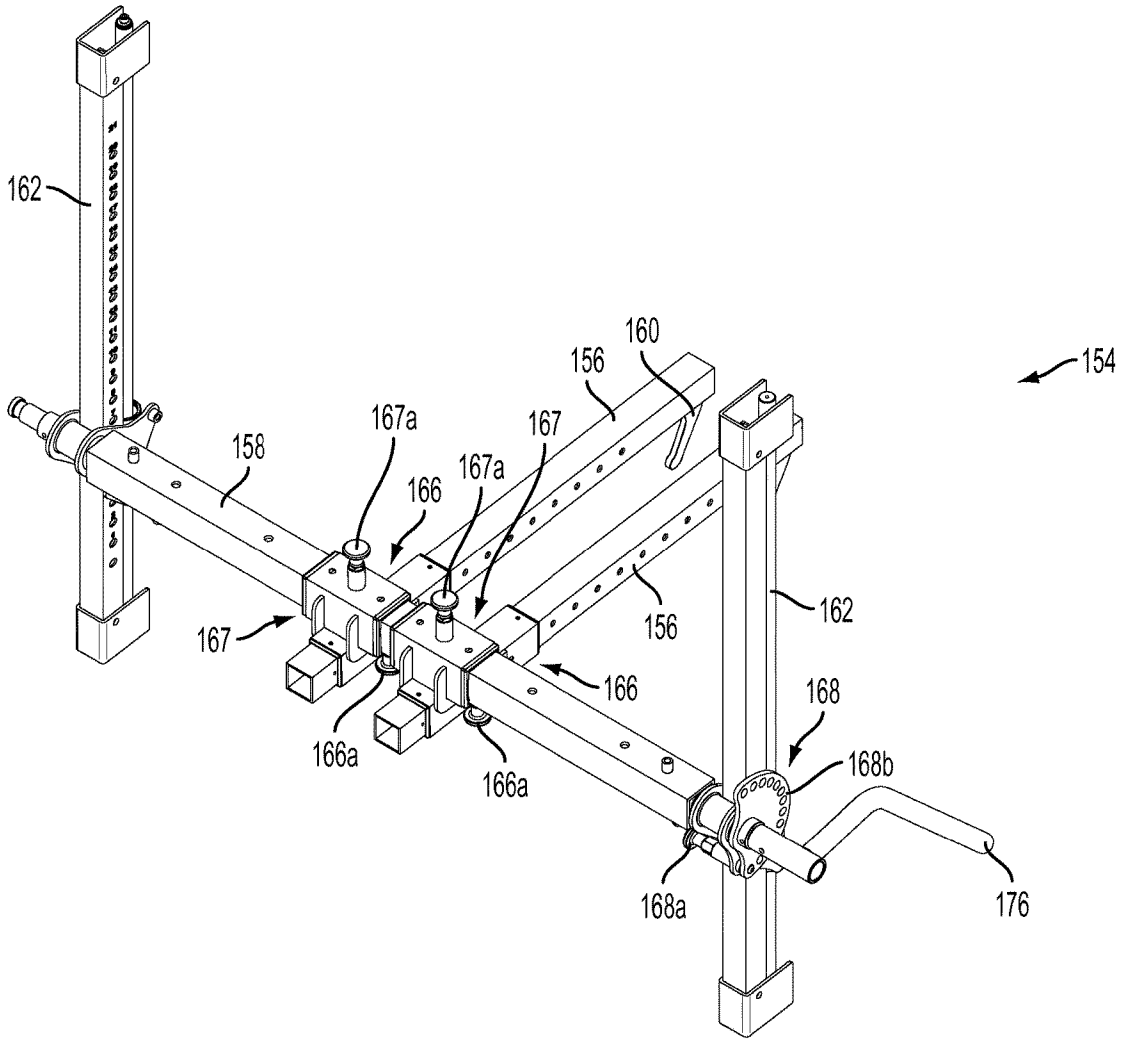
FIG. 9 is a perspective view of the monolift assembly shown removed from the exercise machine.
Figure 10:
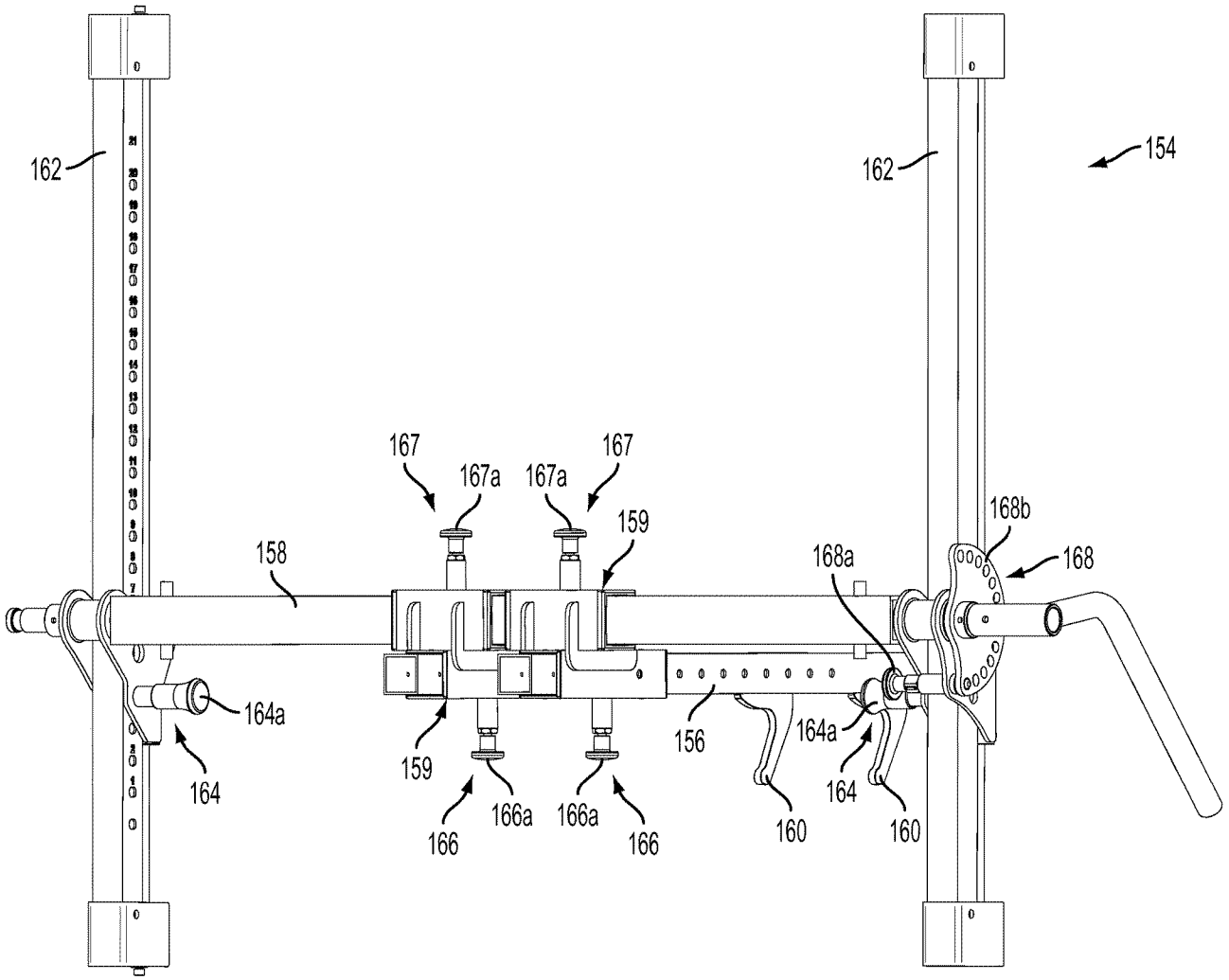
FIG. 10 is a perspective view of the monolift assembly of FIG. 9.

With reference now to FIGS. 8 and 17-19B, example exercise attachments are provided for use with the machine 100 (each of which may also be used in connection with the machine 100 illustrated in FIGS. 1 and 2, or any other machine 100 of the present disclosure). As shown in FIG. 8, one such attachment includes the support 170 configured to be positioned in the monolift assembly 154. In the illustrated embodiment, the support 170 may include a support portion 170*a* and a support arm 170*b* configured to couple to the frame member 158 of the monolift assembly 154 in place of one of the arms 156 (or in place of both of the arms 156). The support 170 can then be used in conjunction with the cable system (e.g., as an adjustable stabilizer to support a body of a lifter, etc.) to perform desired exercise movements (e.g., chest fly movements using fly arms, arm movements using one or more of the cable arm assemblies 110, 112, 114, etc.). Alternatively, a support (e.g., without a support arm, etc.) may be placed over the hook 160 of one of the arms 156 of the monolift assembly 154 (or over the hooks 160 of both of the arms 156) (when the arms 156 of the monolift assembly 154 are rotated generally outwardly) and secured thereto by suitable structure. The support portion 170*a* of the support 170 may include a foam material. Or, other materials may be used within the scope of the present disclosure. For example, the support portion 170*a* may alternatively include an inflatable support portion (e.g., an exercise ball (e.g., a full spherical ball, a half ball such as half ball 203 illustrated in FIGS. 1 and 2, etc.), inflatable (e.g., air-filled, etc.) support portions have shapes other than spherical or half-spherical (e.g., oval, half-oval, polygonal, etc.), etc.), etc.

Figure 17:
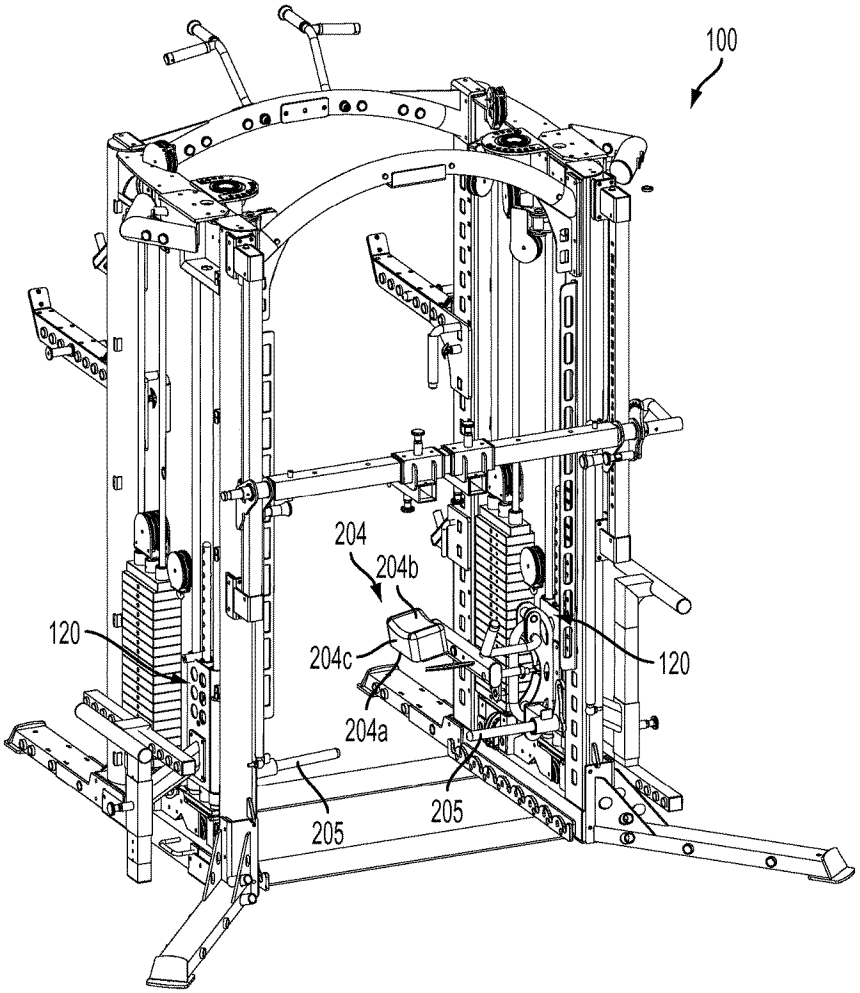
FIG. 17 is another perspective view of the exercise machine of FIG. 1 illustrating various exercise attachments of the exercise machine.

As shown in FIG. 17, another such attachment includes a pad member 204 configured to couple to the carriage 120 (e.g., in adjacent openings 136 of the carriage 120 via the connection system previously described and illustrated in FIGS. 13 and 14), etc.). The pad member 204 can be oriented relative to the carriage 120 in various different positions to allow different exercise movements to be performed. For example, a generally flat plate portion 204*a* of the pad member 204 can be positioned generally downwardly to allow a lifter (e.g., a lifter laying on the exercise bench 108 in the machine 100, etc.) to perform a vertical leg press movement, etc. Or, a concave portion 204*b* of the pad member 204 can be positioned generally downwardly to allow a lifter to perform a squat movement, etc. Or, a side portion 204*c* of the pad member 204 can be positioned generally downward to allow a lifter to perform a vertical calf press (e.g., a lifter laying on the exercise bench 108 in the machine 100, etc.), a seated calf press (e.g., a lifter sitting on the exercise bench 108 in the machine 100, etc.), etc. In some aspects, the pad member 204 will be coupled to one of the carriages 120 so that unilateral exercise movements can be performed (e.g., movements using a single leg, etc.). In other aspects, a pad member 204 will be coupled to each of the carriages 120 so that bilateral movements can be performed (e.g., movements using both legs, etc. at the same time). As discussed below, a crossbar (e.g., bar attachment 206, etc.) can also be coupled to the carriages 120, and allow the pad member 204 (as well as any other attachments described herein) to be used.

As also shown in FIG. 17, another such attachment includes a handle 205 configured to couple to the carriage 120 (e.g., in adjacent openings 136 of the carriage 120 via the connection system previously described and illustrated in FIGS. 13 and 14), etc.).

Figure 18:
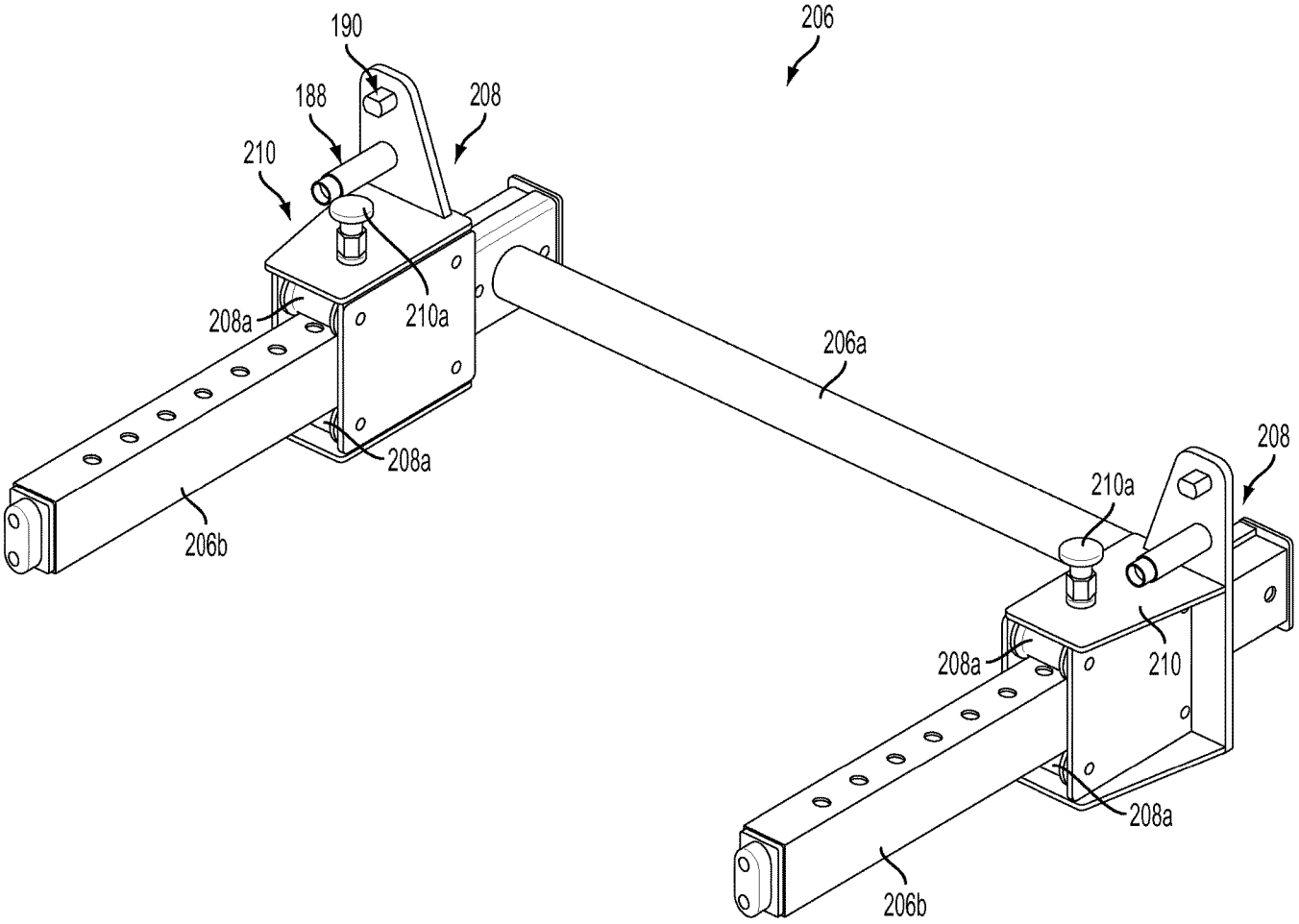
FIG. 18 is a perspective view of an adjustable bar attachment suitable for use with the exercise machine of FIG. 1.

As shown in FIG. 18, another such attachment includes an adjustable bar attachment 206. Mounting fixtures 208 of the attachment are configured to couple (e.g., in adjacent openings 136 of the carriages 120 via the connection system previously described and illustrated in FIGS. 13 and 14), etc.) to corresponding ones of the carriages 120 (such that the bar attachment 206 is coupled to both of the carriages 120 at the same time (e.g., bridging the carriages 120, etc.)). As such, a bar portion 206*a* of the attachment 206 generally extends across a width of the machine 100, for example, for simulating a barbell in the machine 100, etc. The bar portion 206*a* is adjustable horizontally relative to the machine 100. Arms 206*b* of the attachment 206 (coupled to the bar portion 206*a*) are moveable through the mounting fixtures 208 via a roller system 208*a* (alternatively, bearing systems, etc. could be used) for adjusting a spacing between the bar portion 206*a* and the mounting fixtures 208 (to locate the bar portion 206*a* in a desired position for performing various exercise movements). As such, a position of the bar portion 206*a* in the machine 100 can be adjusted both vertically (via the carriages 120) and horizontally (via the arms 206*b*) for accommodating different sized lifters and/or different types of exercise movements. Adjustable pin systems 210 (e.g., pull pins 210*a*, etc.) (broadly, adjustment systems) are provided to secure the bar portion 206*a* in the desired position (e.g., with the pull pins 210*a* fitting into desired openings of the arms 206*b*, etc.). In use, a lifer can move the bar portion 206*a* of the attachment 206 in performing an exercise movement to thereby substantially simultaneously move the carriages 120 (and their associated weight stacks 104). In some aspects, the bar portion 206*a* may include receptacles (e.g., openings, etc.) for use in coupling desired attachments (e.g., pad member 204 (FIG. 17), footplate attachment 220 (FIG. 19B), etc.) to the bar (e.g., via the connection system previously described (FIG. 14), etc.).

Figure 19A:
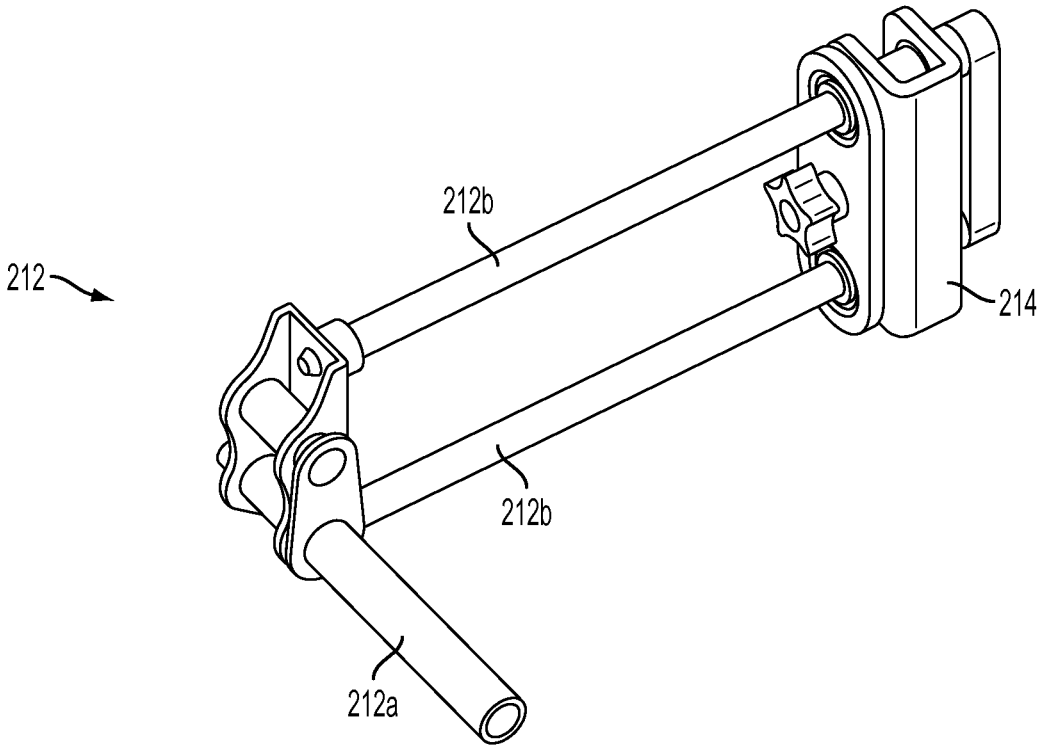
FIG. 19A is a perspective view of an example embodiment of a handle attachment suitable for use with the exercise machine of FIG. 1.

FIG. 19A illustrates a handle attachment 212 suitable for use with the machine 100. The handle attachment 212 generally includes a mounting fixture 214 configured to couple the attachment 212 to one of the carriages 120 of the exercise machine 100 (e.g., in adjacent openings 136 of the carriage 120 via the connection system previously described and illustrated in FIGS. 13 and 14), etc.). The attachment 212 also includes a grip 212*a* and a pair of support arms 212*b* coupling the grip 212*a* to the mounting fixture 214. The support arms 212*b* are moveable relative to the mounting fixture 214 to allow for adjusting a horizontal position of the grip 212*a* (e.g., via a locking system, etc. configured to selectively secure and release the grip 212*a* in and from desired positions, etc.). In use, a lifter can push/pull on the grip 212*a* and thereby move the carriage 120 (and its associated resistance) in performing desired exercise movements. In some aspects, the single attachment 212 may be used, with it coupled to one of the carriages 120 so that unilateral movements can be performed (e.g., movements using a single hand grasping the grip, etc.). In other aspects, two of the attachments 212 may be used with one such attachment coupled to each of the carriages 120 so that bilateral movements can be performed (e.g., movements using both legs, both calves, etc. at the same time). In other example embodiments, attachments may include handles that slide along support arms to thereby allow for adjustment of the handles.

In other example embodiments, handle attachments may include mounting fixtures configured to couple the attachments to carriages of exercise machines (e.g., via the connection system previously described, etc.). The attachments may also include grips and support arms coupling the grips to the mounting fixtures. The grips are moveable relative to the support arms to allow for adjusting horizontal positions of the grips (e.g., during performance of an exercise movement, before performance of an exercise movement, etc.). In use, lifters can move the grips and thereby move the carriages 120 (and their associated resistances) in performing desired exercise movements. In some aspects, single attachments may be used with them coupled to one of the carriages so that unilateral movements can be performed (e.g., movements using a single hand grasping the grip, etc.). In other aspects, two of the attachments may be used with one such attachment coupled to each of the carriages so that bilateral movements can be performed (e.g., movements using both legs, both calves, etc. at the same time).

Figure 19B:
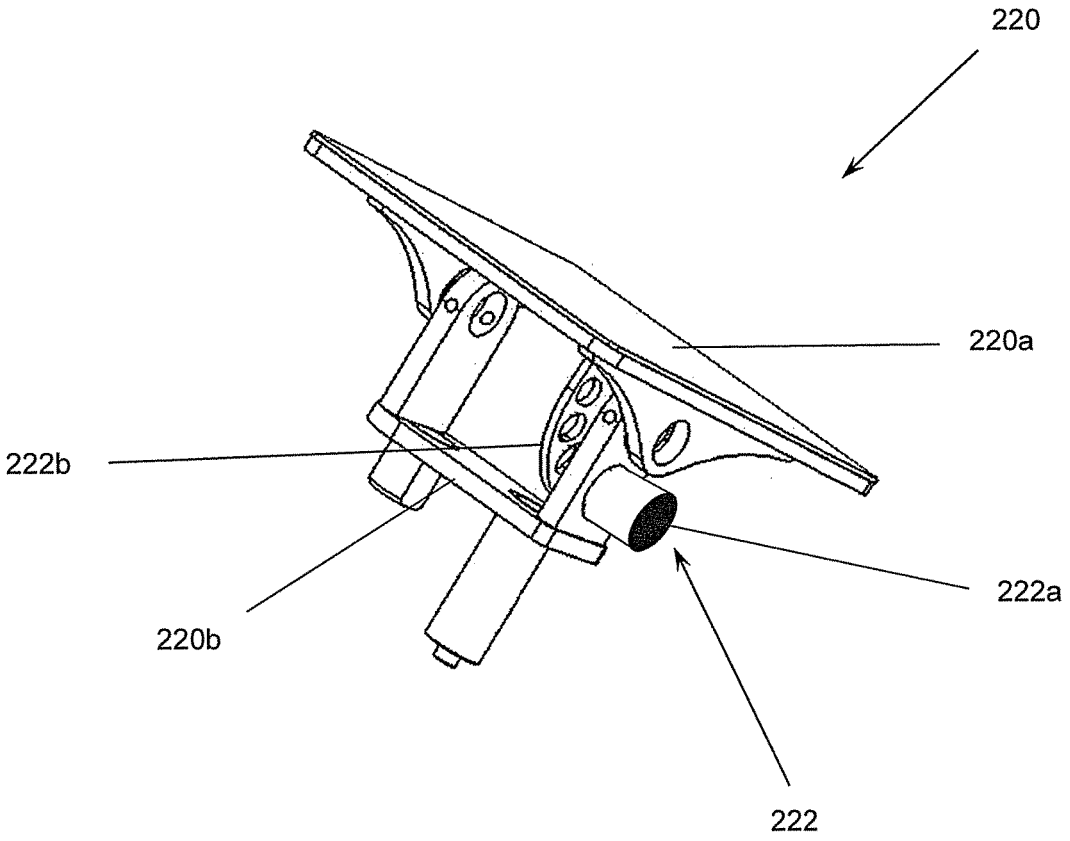
FIG. 19B is a perspective view of an example embodiment of multifunctional foot plate attachment suitable for use with the exercise machine of FIG. 1.

FIG. 19B illustrates a multifunctional adjustable footplate attachment 220 suitable for use with the machine 100. The footplate attachment 220 can be coupled to various different portions of the machine 100 (e.g., in adjacent openings 136 of the carriage 120, adjacent openings of the platform 140, adjacent openings of the bar attachment 206, etc.) (e.g., via the connection system previously described and illustrated in FIGS. 13 and 14), etc.) to allow for performing different exercises. The footplate attachment 220 includes a generally flat foot portion 220*a* for supporting a user, and a mounting fixture 220*b* for coupling the footplate attachment 220 to the desired portion of the machine 100. An adjustable pin system 222 (e.g., a pin 222*a* and an adjustment disc 222*b* with openings for selectively receiving the pin 222*a*, etc.)

(broadly, an adjustment system) is provided to secure the foot portion 220*a* in a desired rotational position relative to the mounting fixture 220*b* for use in performing desired exercises.

Further, additional attachments such as swing apparatus (e.g., plyo-swings, etc.) and pivotable arms (e.g., jammer arms, etc.) may be used with the machine 100 of this embodiment (or any other machine 100 of the present disclosure). As an example, a swing apparatus can be configured to be positioned in the monolift assembly 154. The arms 156 of the monolift assembly 154 are initially rotated (via the handle 176) to a desired position (and adjusted to a desired height), and the swing apparatus is then coupled thereto (e.g., via supports, tethers, etc. coupled to the hooks 160 of the arms 156, etc.). A lifter can then sit in a chair portion of the of the swing apparatus and swing forward and backward within the machine 100 to perform various plyometric arm, leg, etc. exercise movements. In some aspects, the lifter can swing freely within the machine 100 (e.g., by pushing against a portion of the machine 100, etc.). In other aspects, the swing apparatus is coupled to the weight stacks 104 of the machine 100, resistance bands, free weights (e.g., extending from the chair portion, etc.), other forms of resistance, etc. to provide resistance to the swinging movement. In one example use of the swing apparatus, the platform 140 of the machine 100 can be positioned to allow the lifter to push against the platform 140 (with the lifter's legs) to create the swinging movement to perform leg exercise movements (e.g., leg presses, jumps, etc.). As another example, pivotable arms can be configured to be positioned in the monolift assembly 154. The pivotable arms are configured to couple to the frame member 158 of the monolift assembly 154 in place of the monolift arms 156. The pivotable arms (and handles thereof) can then be rotated (and adjusted to a desired height) for use in performing exercise movements using the arms (e.g., chest presses, shoulder presses, rows, etc.). In some aspects, the pivotable arms may also include a joint that further allows for horizontal movement, adjustment, etc. of the arms. As can be appreciated, the pivotable arms can thus provide quick and easy arm/handle height adjustment and pivot height adjustment for lifters.

In other example embodiments, exercise machines may include carriages and/or weight stacks that make use of different styles of pins to select weights, etc. In still other example embodiments, exercise machines may include weight stacks located separately from carriages (e.g., on separate guides from the carriages, etc.), but still coupled (e.g., tethered, etc.) to the carriages (e.g., via cables and pulleys, etc.) where cables may be coupled between the weight stacks and the carriages (or, alternatively, between selector rods associated with the weight stacks and the carriages, etc.), or cables may be anchored to plates that can then be coupled to the carriages (or, alternatively, to the selector rods associated with the carriages, etc.), etc.

Figure 20:
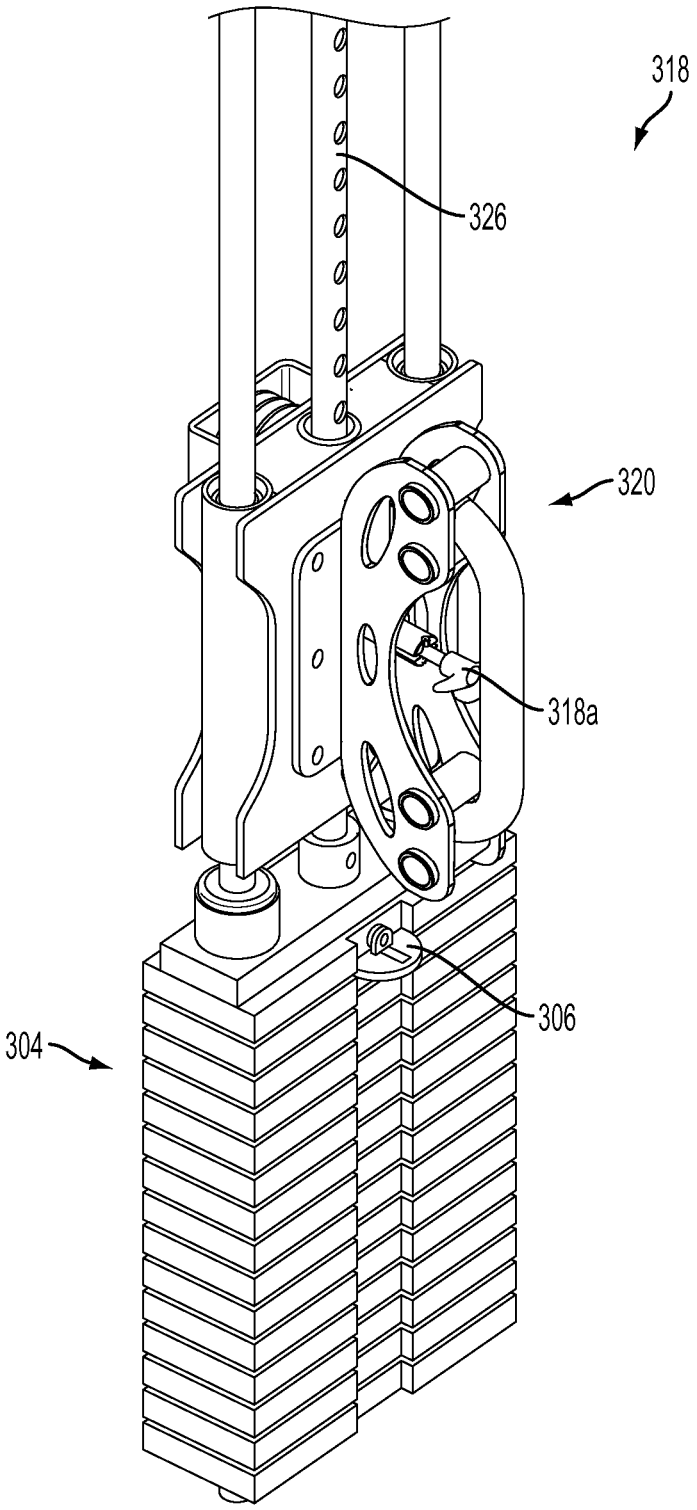
FIG. 20 is a perspective view of an example embodiment of a weight stack and carriage suitable for use with an exercise machine of the present disclosure, where the carriage is shown positioned generally above the weight stack.

FIG. 20 illustrates another example embodiment of a carriage assembly 318 according to the present disclosure, and suitable for use with the exercise machine 100 previously described and illustrated in FIGS. 1-19B. The carriage assembly 318 includes a carriage 320 and weight stack 304. In this embodiment, a selector post 326 extends through the carriage 320 and through weight plates (e.g., through central openings of the weight plates, etc.) of the weight stack 304 for use in coupling the carriage 320 to the weight stack 304. A pin 320*a* (e.g., a spring loaded plunger type pull pin, etc.) is provided for selectively coupling the carriage 320 to the selector post 326 (e.g., via engagement of the pin 320*a* in apertures formed in the selector post 326, etc.), at a desired location (e.g., height, elevation, etc.) along the selector post 326. The location of the carriage 320 along the selector post 326 can be adjusted, as desired, by moving the pin 320*a* to uncouple the carriage from the selector post 326 (e.g., moving the pin 320*a* out of a hole of the selector post 326, etc.), sliding the carriage 320 to a new location along the selector post 326, and then moving the pin 320*a* to recouple the carriage 320 to the selector post 326 (e.g., moving the pin 320*a* into another hole of the selector post 326, etc.). And, another pin 306 is provided for selecting the desired weight plates (e.g., for inserting under a select one of the weight plates and into engagement with the second selector post 326, etc.) to thereby allow for movement of the select one of the weight plates (and all weight plates there above) together with the carriage 320. Further, the pin 306 can be selectively removed and reinserted under different ones of the weight plates (into engagement with the selector post 326 at corresponding elevations along the selector post 326) so that different numbers of the weight plates can be selected for movement with the carriage 320.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exercise bench for supporting users on a surface when performing exercises, the exercise bench comprising:

a frame;

a seat portion;

a back portion;

a carrier unit supporting the seat portion and the back portion on the frame, the carrier unit moveable along a guide rail relative to the frame for moving the seat portion and the back portion in a longitudinal direction relative to the frame;

a support moveably coupled to the frame and disposed generally below the back portion and/or the seat portion, the support moveable relative to the frame in the longitudinal direction of the frame to thereby extend longitudinally from the frame; and a receptacle coupled to the frame, the support extending at least partly through the receptacle such that the receptacle guides the movement of the support relative to the frame, the receptacle positioned on the frame at a location lower than the guide rail;

wherein the support, when extended from the frame, is configured to engage the surface and provide additional stability to the exercise bench when the seat portion and the back portion move in the longitudinal direction relative to the frame.

2. The exercise bench of claim 1, wherein the frame includes a footing for supporting the exercise bench on the surface, the footing defining opposing receptacles for releasably coupling desired attachments to the frame on generally opposite sides of the frame at one of multiple different transverse positions relative to the longitudinal axis of the frame; and wherein the receptacle through which the support extends is coupled to the frame at the footing and is oriented generally perpendicular to the opposing receptacles.

3. The exercise bench of claim 2, wherein the attachments are selected from the group consisting of engagement members for releasably coupling the exercise bench to a multifunctional exercise machine and foot plates for allowing users to stand thereon when using the exercise bench.

4. The exercise bench of claim 2, further comprising engagement members for releasably coupling the exercise bench to a multifunctional exercise machine, wherein the engagement members are configured to couple to the footing of the frame, wherein each of the engagement members includes a slidable lock configured to releasably engage the multifunctional exercise machine to inhibit rotation of the bench when coupled to the multifunctional exercise machine and an adjustment system to adjust position of the engagement members relative to the frame, and wherein each of the engagement members includes first and second tabs for coupling the engagement members to the footing of the frame.

5. The exercise bench of claim 4, wherein the engagement members are each moveable relative to the frame in a direction generally transverse to a longitudinal axis of the exercise bench while the engagement members are coupled to the footing of the frame.

6. A multifunctional exercise machine comprising the exercise bench of claim 4, wherein:

the multifunctional exercise machine includes a frame and at least one guide coupled to the frame of the multifunctional exercise machine; and at least one of the engagement members of the exercise bench is configured to couple to the at least one guide to thereby couple the exercise bench to the multifunctional exercise machine.

7. The multifunctional exercise machine of claim 6, wherein at least one of the slidable locks associated with the engagement members is configured to inhibit rotation of the exercise bench when coupled to the multifunctional exercise machine.

8. The multifunctional exercise machine of claim 6, wherein the multifunctional exercise machine includes at least one weight stack, and wherein the exercise bench is configured to couple to the at least one weight stack of the multifunctional exercise machine.

9. The exercise bench of claim 1, further comprising at least one engagement member configured to releasably couple the exercise bench to a multifunctional exercise machine.

10. The exercise bench of claim 9, wherein the at least one engagement member is adjustable in a direction generally transverse to a longitudinal axis of the frame, to thereby adjust a position of the exercise bench relative to the multifunctional exercise machine.

11. The exercise bench of claim 1, wherein the carrier unit comprises rollers configured to support the movement of the carrier unit along the guide rail.

12. The exercise bench of claim 1, wherein the seat portion is rotatable relative to the frame, and wherein the back portion is rotatable relative to the frame.

13. The exercise bench of claim 1, wherein the carrier unit comprises bearings supporting movement of the carrier unit relative to the frame.

14. The exercise bench of claim 1, wherein the support includes a tongue extending through the receptacle in a direction generally parallel to the guide rail.

15. The exercise bench of claim 1, further comprising at least one attachment configured to releasably couple to the frame, the at least one attachment selected from the group consisting of an engagement member for releasably coupling the exercise bench to a multifunctional exercise machine and a foot plate for allowing a user to stand thereon when using the exercise bench.

16. The exercise bench of claim 1, wherein the guide rail is a first guide rail; and further comprising the first guide rail and a second guide rail, the carrier unit moveable along the first and second guide rails relative to the frame for moving the seat portion and the back portion in a longitudinal direction relative to the frame.

17. The exercise bench of claim 1, wherein the receptacle is oriented generally parallel to the first guide rail.

18. An exercise bench for supporting users when performing exercises, the exercise bench comprising:

a frame defining opposing receptacles for releasably coupling desired attachments to the frame on generally opposite sides of the frame at one of multiple different horizontal positions relative to a longitudinal axis of the frame;

a seat portion;

a back portion;

a carrier unit supporting the seat portion and/or the back portion on the frame, the carrier unit moveable relative to the frame for moving the seat portion and/or the back portion in a direction generally parallel to the longitudinal axis of the frame; and a support moveably coupled to the frame and disposed generally below the back portion and/or the seat portion, the support moveable relative to the frame in a direction generally parallel to the longitudinal axis of the frame to thereby extend longitudinally from the frame, whereby the support provides additional stability to the exercise bench when the seat portion and/or the back portion move in the direction generally parallel to the longitudinal axis of the frame;

wherein the support inhibits at least some movement of the seat portion and/or the back portion in the direction generally parallel to the longitudinal axis of the frame, unless the support is extended longitudinally from the frame.

19. The exercise bench of claim 18, further comprising at least one of the desired attachments, wherein the at least one of the desired attachments includes an engagement member configured to releasably couple the exercise bench to a multifunctional exercise machine.

20. The exercise bench of claim 19, wherein the engagement member is adjustable in a direction generally transverse to the longitudinal axis of the frame, to thereby adjust a position of the exercise bench relative to the multifunctional exercise machine.

21. The exercise bench of claim 20, wherein the engagement member is adjustable in the direction generally transverse to the longitudinal axis of the frame while the exercise bench is coupled to the multifunctional exercise machine.

22. The exercise bench of claim 18, wherein the support includes wheels.

23. An exercise bench for supporting users when performing exercises, the exercise bench comprising:

a frame;

a seat portion;

a back portion;

a carrier unit supporting the seat portion and/or the back portion on the frame, the carrier unit moveable relative to the frame for moving the seat portion and/or the back portion in a direction generally parallel to a longitudinal axis of the frame; and at least one engagement member configured to releasably couple the exercise bench to a multifunctional exercise machine, the at least one engagement member including tabs positioned along the at least one engagement member and extending away from the at least one engagement member for selectively positioning within openings of the multifunctional exercise machine to thereby releasably couple the exercise bench to the multifunctional exercise machine, the at least one engagement member adjustable in a generally horizontal direction relative to the longitudinal axis of the frame to thereby position the tabs in one of multiple different horizontal positions relative to the longitudinal axis of the frame and, when the exercise bench is coupled to the multifunctional exercise machine, to thereby adjust a position of the exercise bench relative to the multifunctional exercise machine.

24. The exercise bench of claim 23, wherein the at least one engagement member is adjustable in a generally horizontal direction relative to the longitudinal axis of the frame while the exercise bench is coupled to the multifunctional exercise machine.

25. The exercise bench of claim 23, further comprising a support moveably coupled to the frame and disposed generally below the back portion and/or the seat portion, the support moveable relative to the frame in a direction generally parallel to the longitudinal axis of the frame to thereby extend longitudinally from the frame, whereby the support provides additional stability to the exercise bench when the seat portion and/or the back portion move relative to the frame.

26. The exercise bench of claim 25, wherein the carrier unit is engageable with the support, such that movement of the seat portion and/or the back portion relative to the frame, via the carrier unit, also moves the support relative to the frame.

27. The exercise bench of claim 23, wherein the tabs of the at least one engagement member include first and second tabs.

* * * * *